US010724724B2

(12) United States Patent
Ericson et al.

(10) Patent No.: US 10,724,724 B2
(45) Date of Patent: Jul. 28, 2020

(54) LIGHTING DEVICES AND METHODS

(71) Applicant: Global Network Lighting & Control, Inc., West Hills, CA (US)

(72) Inventors: Philip Gustav Ericson, West Hills, CA (US); Jeffrey Lawrence Harlan, Corona, CA (US); Wade Lane Morgan, Homeland, CA (US); Charles Edward Markley, Anaheim, CA (US)

(73) Assignee: Philip Gustav Ericson, West Hills, CA (US)

( * ) Notice: Subject to any disclaimer, the term of this patent is extended or adjusted under 35 U.S.C. 154(b) by 139 days.

(21) Appl. No.: 15/271,150

(22) Filed: Sep. 20, 2016

(65) Prior Publication Data

US 2017/0089557 A1 Mar. 30, 2017

Related U.S. Application Data

(60) Provisional application No. 62/232,395, filed on Sep. 24, 2015, provisional application No. 62/232,359, (Continued)

(51) Int. Cl.

| | |
|---|---|
| ***F21V 23/04*** | (2006.01) |
| ***F21S 4/28*** | (2016.01) |
| ***F21S 8/04*** | (2006.01) |
| ***H05B 45/00*** | (2020.01) |
| *F21Y 115/10* | (2016.01) |
| *F21Y 103/10* | (2016.01) |
| *F21V 15/01* | (2006.01) |
| *F21V 31/00* | (2006.01) |
| *F21V 29/70* | (2015.01) |
| *F21V 23/06* | (2006.01) |
| *F21V 23/02* | (2006.01) |
| *F21V 3/06* | (2018.01) |
| *F21V 17/16* | (2006.01) |

(52) U.S. Cl.

CPC ..... *F21V 23/0471* (2013.01); *F21S 4/28* (2016.01); *F21S 8/04* (2013.01); *H05B 45/00* (2020.01); *F21V 3/0625* (2018.02); *F21V 15/01* (2013.01); *F21V 17/164* (2013.01); *F21V 23/023* (2013.01); *F21V 23/0457* (2013.01); *F21V 23/0464* (2013.01); *F21V 23/06* (2013.01); *F21V 29/70* (2015.01); *F21V 31/005* (2013.01); *F21Y 2103/10* (2016.08); *F21Y 2115/10* (2016.08)

(58) Field of Classification Search

CPC ..... F21S 4/28; F21S 8/04; F21V 23/0471; F21V 23/0457; F21V 23/06; F21V 31/005

See application file for complete search history.

(56) References Cited

U.S. PATENT DOCUMENTS 6,132,238 A 10/2000 Hartmann et al.
6,673,292 B1 1/2004 Gustafson
(Continued)

*Primary Examiner* — Karabi Guharay
(74) *Attorney, Agent, or Firm* — Fish IP Law, LLP

(57) ABSTRACT

Lighting systems that provide improvements in various aspects are contemplated. In one aspect, light fixtures can comprise at least one of an occupancy sensor, a constant current module, an external power supply, a plurality of lighting elements mounted on a heat sink, a sealing mechanism, and top and bottom housings having tabs to removably couple with one another. In another aspect, a disconnect comprising a plug and socket housing is contemplated.

9 Claims, 38 Drawing Sheets

Related U.S. Application Data filed on Sep. 24, 2015, provisional application No. 62/232,383, filed on Sep. 24, 2015, provisional application No. 62/232,374, filed on Sep. 24, 2015, provisional application No. 62/232,391, filed on Sep. 24, 2015, provisional application No. 62/232,399, filed on Sep. 24, 2015, provisional application No. 62/232,369, filed on Sep. 24, 2015.

(56) References Cited

U.S. PATENT DOCUMENTS

| | | | | |
|---|---|---|---|---|
| 7,731,522 | B2 | 6/2010 | Keswani | |
| 7,753,718 | B2 | 7/2010 | Bethurum | |
| 7,922,354 | B2 | 4/2011 | Everhart | |
| 7,959,445 | B1 * | 6/2011 | Daily | H01R 12/716 439/65 |
| 7,988,481 | B2 | 8/2011 | Bethurum | |
| 8,148,854 | B2 | 4/2012 | Shah | |
| 8,579,650 | B2 | 11/2013 | Keswani | |
| 9,029,781 | B2 | 5/2015 | Huang | |
| 2006/0056169 | A1 * | 3/2006 | Lodhie | F21S 8/086 362/97.3 |
| 2006/0061329 | A1 | 3/2006 | Dawson | |
| 2009/0021933 | A1 * | 1/2009 | Mayer | F21S 8/086 362/240 |
| 2009/0218923 | A1 * | 9/2009 | Gingrich, III | F21K 9/00 313/1 |
| 2011/0149548 | A1 | 6/2011 | Yang | |
| 2011/0266282 | A1 | 11/2011 | Chu | |
| 2013/0271034 | A1 * | 10/2013 | Tang | H05B 33/0812 315/307 |
| 2014/0240844 | A1 * | 8/2014 | Scherrer | G02B 3/00 359/642 |
| 2015/0198760 | A1 * | 7/2015 | Wilcox | G02B 6/0038 362/606 |

* cited by examiner

LIGHTING DEVICES AND METHODS

This application claims priority to U.S. Provisional Application No. 62/232,395, filed Sep. 24, 2015, U.S. Provisional Application No. 62/232,359, filed Sep. 24, 2015, U.S. Provisional Application No. 62/232,383, filed Sep. 24, 2015, U.S. Provisional Application No. 62/232,374, filed Sep. 24, 2015, U.S. Provisional Application No. 62/232,391, filed Sep. 24, 2015, U.S. Provisional Application No. 62/232,399, filed Sep. 24, 2015, and U.S. Provisional Application No. 62/232,369, filed Sep. 24, 2015. All extrinsic materials identified herein are incorporated by reference in their entirety.

FIELD OF THE INVENTION

The field of the invention is lighting systems and methods.

BACKGROUND

The background description includes information that may be useful in understanding the present invention. It is not an admission that any of the information provided herein is prior art or relevant to the presently claimed invention, or that any publication specifically or implicitly referenced is prior art.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

A. Background on LED Systems

Solid-state light emitting electronic elements, such as, for example, light emitting diodes ("LEDs"), have been developed that output intense white light. Such solid-state electronic devices emit light as a function of input current. Thus, the output light intensity can be readily varied by moderating or adjusting the supplied current. To maintain a constant light level, LEDs require a constant current supply of power. Various applications of lighting require different levels of light intensity. One approach to generating different light levels is to use different quantity of LEDs. Another approach is to change the level of current supplied to a fixed number of LEDs.

Once in the field, conventional light fixtures cannot adjust maximum output light levels and often supply more light than necessary which uses more power than necessary. Thus, there is a need in the art for improved light fixtures.

B. Background on Light Systems with Occupancy Sensors

A typical lighting control system uses an integrated occupancy sensor for actuating light fixtures without operating a manual switch. Conventionally, lighting contractors are integrating off-the-shelf occupancy sensors with light fixtures from various vendors and either AC line voltage or low-voltage 12-24 VDC power depending on what is available in the light fixture or local wiring system. The prior art involves a separate sensor housing, a power supply stage independent from the lighting fixture, a signal wire to interface with the lighting fixture, and a mechanical connector/fastener to mount the sensor housing to the light fixture.

Typically the vendors that make light fixtures are not the same vendors making occupancy sensors. As such, occupancy sensor vendors manufacture generic occupancy sensors that will work with virtually any light fixture or lighting control system. The electronics in the occupancy sensor is powered independently from the light fixture electronics and do not have the efficiency of combining the power stage of the products. Alternatively, the power input to the occupancy sensor may not even be available in the light fixture, which can affect the manufacturer's decision in selecting how to power their products. Thus, there is a need in the art for improved lighting fixtures.

C. Background on Power Connector Systems

A common application of a disconnect for electrical wiring circuits is in commercial light fixtures often referred to as a "luminaire disconnect". Such fixtures require an electronic driver to operate. Drivers are typically hard-wired between the power supply and the lighting elements. When a driver or power supply fails it has to be replaced, which can be problematic. Thus, there is a need in the art for improved lighting systems.

D. Background on Power Distribution Systems

LEDs as a source of lighting are now in the mainstream and the technology uses direct current (DC) rather than alternating current (AC) that conventional lamps and bulbs use. LED lighting arrays can be powered directly via direct current (DC) or use alternating current (AC) to direct current (DC) convertors (AC/DC). At low power (less than 50 W) it is difficult to convert AC to DC power in an efficient manner. As the power requirement is reduced so is the efficiency of conversion, which leads to the paradigm that as LEDs become more efficient, the power conversion becomes less efficient. LEDs used in light fixtures typically have a significantly longer life than conventional lamps or bulbs changing the paradigm of failures in lighting fixtures from one of changing lamps/bulbs to a system dealing with failures of power supplies. While the failure rate of lamps and bulbs is in the range of a few years, failures for power supplies are on the order of 5 to 10 years and LEDs can last 20 to 30 years. Thus, there is a need in the art for improved lighting systems.

E. Background on Sealed Lighting Fixtures

A high performance, high efficiency solid state electronic lighting device, having a sealed fixture body for use in environments requiring Ingress Protection (IP) rated (IEC standard 60529) sealed fixtures, generates heat inside the sealed device from the lighting elements thereby causing electronic inefficiencies of powering and controlling the lighting elements, including optional sensors, such as ambient light, occupancy, temperature, etc. The challenge in the art is to reduce the temperature, which is generated in a sealed lighting fixture. Thus, there is a need in the art for improved lighting systems.

F. Background on Enclosures for LED Systems

A common problem in conventional lighting fixtures in the ingress of dust, insects and other contaminants that build up over time and requires disassembly of the light fixture in order to be cleaned. Keeping bugs and dust out of the inside of the optical lens means that light intensity is not diminished, aesthetics of the light are not affected, and maintenance costs are minimized by not having to open up the fixture to remove the material. It is further desirable to have a sealed light compartment whose design can accommodate the removal of heat from the lighting elements by providing a heat sink for the lighting elements. Regardless of the application, it is advantageous that the LED circuitry is housed within some type of protective enclosure. Thus, there is a need in the art for improved lighting systems.

G. Background on Light Fixture Housings

Light fixtures can vary in difficulty in assembly and disassembly, and often require tools or fasteners. The use of tools and fasteners limits the type of materials that are used to produce light fixtures. This can be problematic when softer materials such as aluminum or copper that offer improved heat dissipation as compared to conventional steel housings. Thus, there is still a need in the art for improved lighting fixture systems.

SUMMARY OF THE INVENTIONS

The inventive subject matter provides apparatus, systems, and methods in which various aspects of lighting can be improved. In one aspect, a light fixture is contemplated in which the maximum light intensity can be finely tuned for a given application, to modify the light intensity for application changes or lumen maintenance reasons without needing to replace the light fixture, and that allows an installer to modify inventory for a specific application rather than order application specific light fixtures and/or needing to return product that does not meet customer requirements.

In another aspect, lighting fixtures are contemplated that use solid state electronic devices as the lighting elements, and in which an occupancy sensor is built into the light fixture thereby placing the occupancy sensor in the center of the lighting element(s). Thus, a light fixture with an integrated occupancy sensor is provided that gives more operational and integration efficiencies.

In another aspect, a disconnect for electrical wiring circuits is contemplated. The disconnect includes a plug and socket housing combination that provides a convenient and safe way to replace circuit elements in live circuits.

In another aspect, a light fixture having an ambient light sensor, an occupancy sensor and control system that adjusts the light output of the solid-state light emitting elements based on the sensed ambient light and on a sensed occupancy level of a sensed area around the light fixture is contemplated. The control system can also receive a control signal from a central location that monitors a total peak energy use by the building or location in which the light fixture is located. In response to this signal, the control system can modify the light output, and/or turn on or off, the solid-state lamps when the overall energy use rises too high or falls back down from a peak energy use period. While leveraging the efficiencies of various technologies, moving the power supply from the light fixture to a common area, the most powerful method of saving energy is to turn the lights off when they are not needed. For this a bi-directional communication link between each individual light fixture and a Host controller offer the greatest savings.

In order to minimize the cost and effort to replace failed power supplies, the power conversion function is moved out of the light fixture and into a common area where the power to support the lighting infrastructure is aggregated to convert AC to DC power at very high efficiencies. By removing the power supply out of the light fixture, an additional benefit is removing a heat-generating source from the light fixture which means the lighting elements will operate at higher efficiencies and generate less heat. The power supplies for the lighting infrastructure can be relocated to an area where ventilating the heat can be handled in a more effective manner. Consequently, the set of common power supplies can be arranged to support redundancy and hot swap functionality, which means the concept of a light failure is minimized and failed power supplies can be replaced without turning the power off or climbing ladders.

In another aspect, lighting fixtures that use solid state electronic devices as the lighting elements are contemplated that mount lighting elements to thereby minimize the detrimental effect of the heat generated by the lighting elements, electronics or power supply, and provide protection from handling or installation mishaps. In contemplated embodiments, a light fixture body can be constructed of a die-cast aluminum. A high strength optical lens, continuous-poured neoprene gasket and cam-action latch system can be used to cover and seal the light fixture assembly. The fixture can have a water resistant IP rating of at least 65, allowing protection from entry of dust, bugs, rain and low pressure power washing. A plurality of lighting elements mounted on one or more printed circuit boards are mounted on a sheet metal heat sink. The sheet metal heat sink is mounted into the high strength optical lens. The lighting elements are protected from mishaps due to handling or installation.

Lighting elements can be relatively fragile from accidental contact caused by installation tools or even a finger nail striking an element. Capturing the lighting elements between the high strength optical lens and the heat sink creates a keep-out area protecting sensitive components. Thus, various advantages are provided. Mounting the LED/driver assembly into the optical lens protects the lighting elements from accidental damage by the installer. The installer can mount the die-cast housing, connect the wires delivering power to the light fixture with typical installation tools. Once installed, the lens/lighting element/driver assembly can be latched to the housing without the use of tools.

In another aspect, an integral light strip containing light emitting diodes (LEDs), and a process for forming such a light strip, in which the LEDs and associated circuitry are protected from dust and insect ingress and from other potential causes of damage is contemplated. An exemplary embodiment provides a light fixture having multiple LED elements, a gasket, optical lens, heat sink and sealing mechanism that seals the light fixture. This embodiment separately provides a light fixture having multiple LED elements and a resistant ingress protection ("IP") rating that allows the light fixture to be used in hostile environments.

In another aspect, lighting fixtures that use solid-state electronic devices as the lighting elements are contemplated. It should be appreciated that a light fixture housing is typically designed to mount and support the lighting element, provide a means to mount the fixture to a ceiling or suspend the fixture from the ceiling on cables and enclose power supplies, electrical wires and disconnect connectors protecting people from contacting live wires and dressing the appearance. More particularly, it is contemplated that installation of the light fixture can be simplified while protecting the lighting elements and providing good temperature performance. Thus, contemplated light fixtures can be quickly assembled and disassembled without tools or fasteners and can support the use of softer materials such as aluminum or copper that offer improved heat dissipation.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

A. Driver Card with Pluggable Constant Current Module

Figure 1:
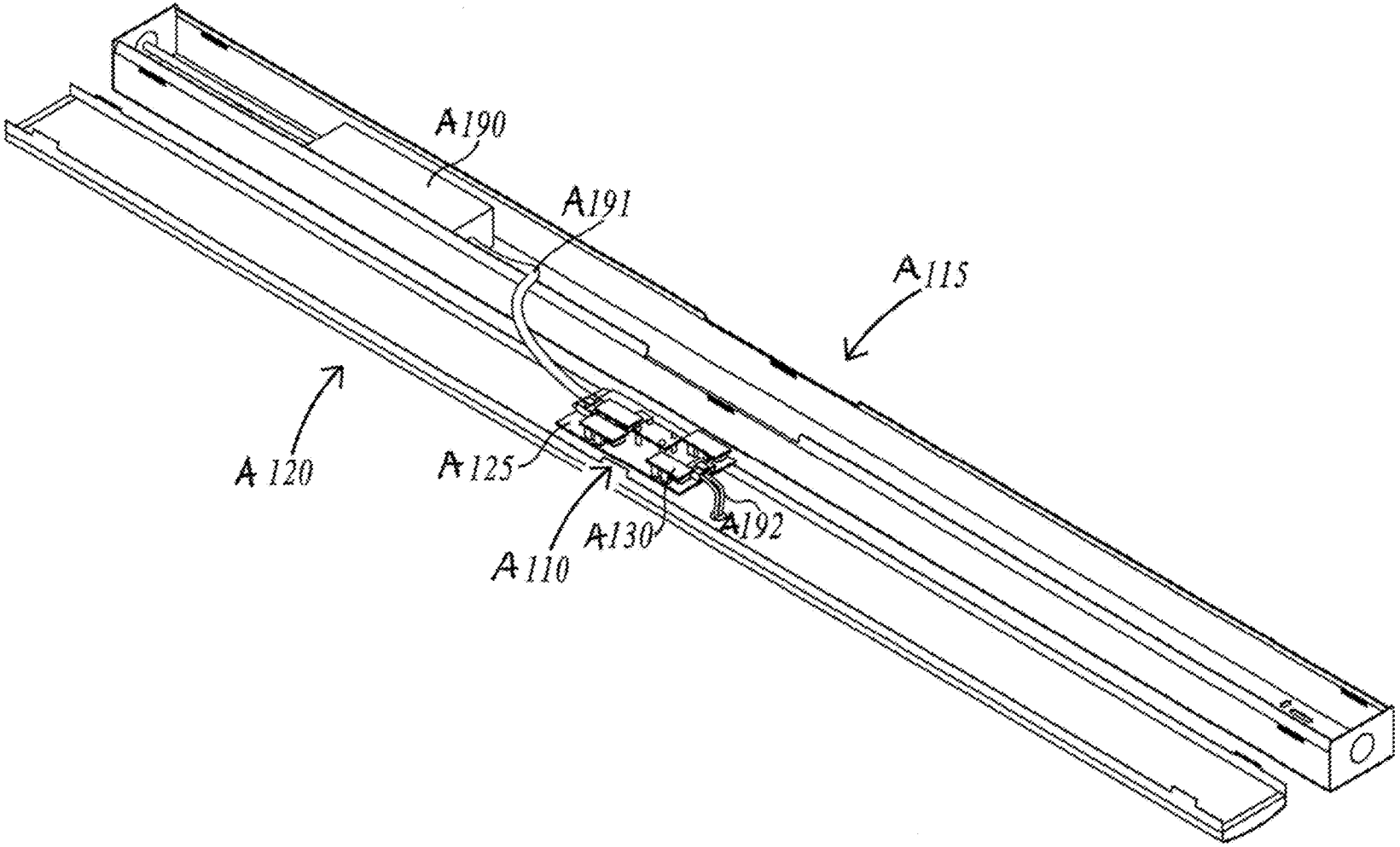
FIG. 1 illustrates an overhead isometric view of a fully installed driver card with pluggable constant current module.

FIG. 1 illustrates an overhead isometric view of a fully installed driver card with pluggable constant current module. In a preferred embodiment, the driver card with pluggable constant current module A110 is installed into a standard light fixture housing comprising a bottom housing A115 and a top cover A120. A printed circuit board, or PCB A125 is attached to an interior surface of said top cover A120. A plurality of pluggable constant current modules A130 can be installed onto the PCB A125. The system includes an optional AC to DC power supply A190 which creates a constant voltage, outputting it to the driver card via incoming wire A191. The driver card sends said constant voltage into the modules A130, which in turn translate the constant voltage into a constant current. This current is sent through the driver card to a string of LEDs found within the lighting structure, via outgoing wire A192. This system offers a novel method of adjusting the level of said current by allowing the interchangeability of said pluggable modules A130; different modules can dictate different current levels. With one standard driver card and multiple modules, an installer can swap out different modules for different currents and change current levels. The installer need only modify their inventory of modules for a specific application, rather than order application-specific light fixtures, and possibly having to return a product that does not meet customer requirements. Additionally, as a solid-state lighting element ages, the light level may deteriorate over time. By changing the constant current module, an aging light can be modified to output additional light, making up for losses due to aging, and thereby increasing the life of the light fixture.

Figure 2:
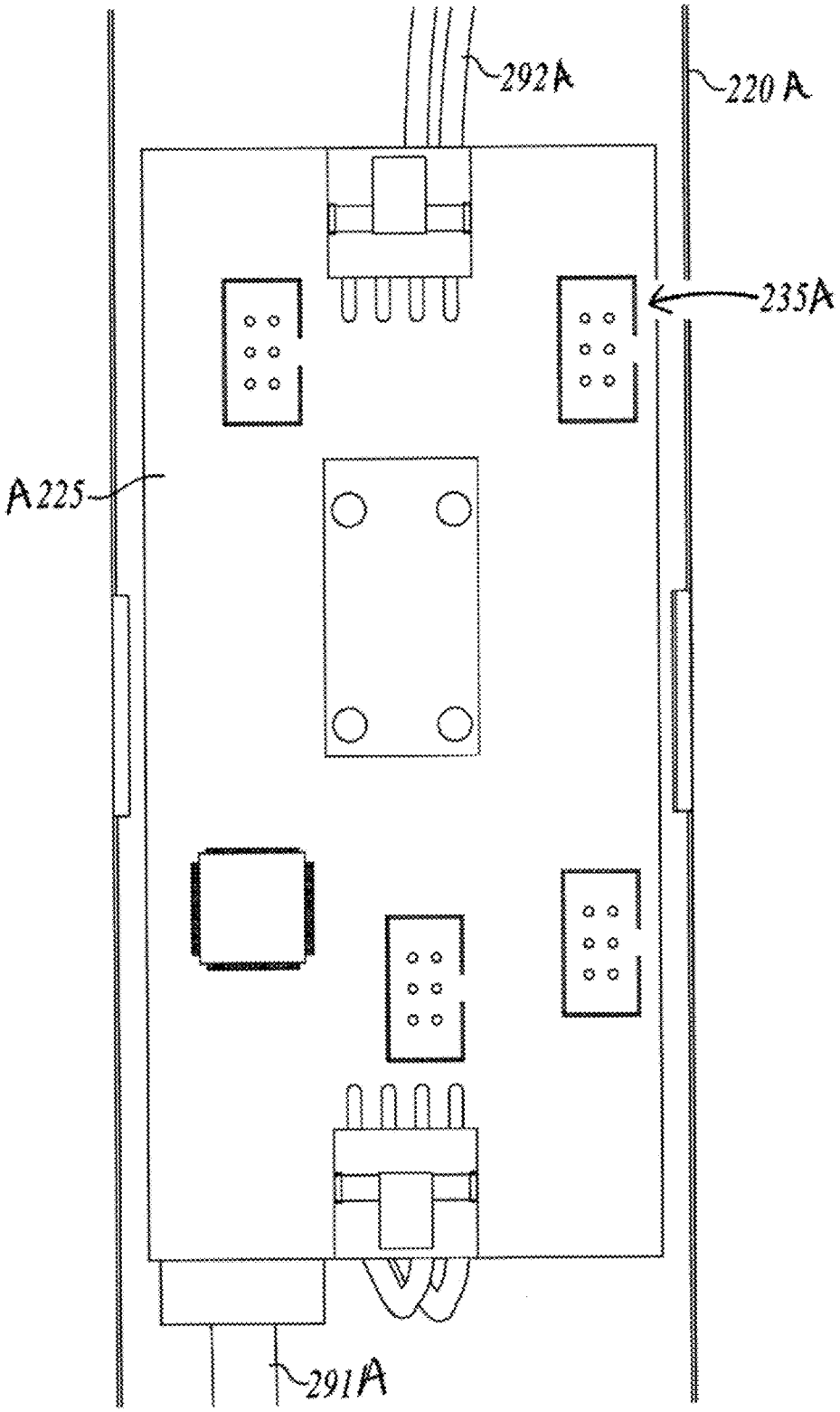
FIG. 2 illustrates an overhead view of a printed circuit board with a group of open sockets which each can receive a pluggable constant current module.

FIG. 2 illustrates an overhead view of a printed circuit board or PCB with a group of open sockets which each can receive a pluggable constant current module. The PCB A225 is attached to an interior surface of a lighting fixture's top cover 220A. In a preferred embodiment, as shown in this view of its component surface, the PCB A225 comprises a plurality of sockets 235A which each are capable of receiving a pluggable constant current module. As with most standard driver electronics, the PCB A225 includes terminals for receiving/outputting power. Incoming wire 291A supplies a constant voltage from the optional power supply, while outgoing wire 292A supplies a constant current to the solid-state lighting elements. An advantage offered by the present invention is the ability to use the same driver card indefinitely, while only replacing interchangeable modules, for a myriad of lighting variations.

Figure 3:
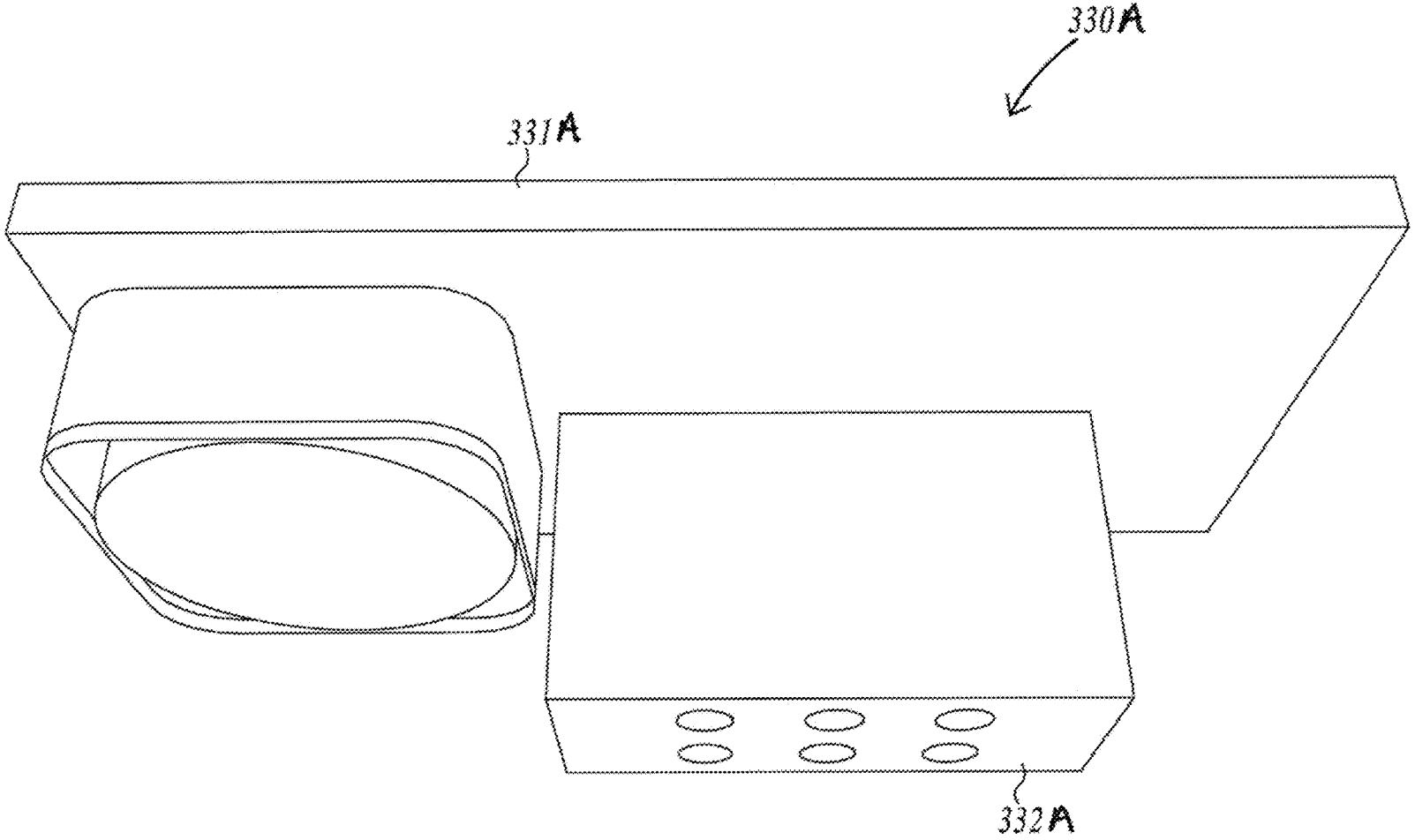
FIG. 3 illustrates a perspective bottom view of a single pluggable constant current module.

FIG. 3 illustrates a perspective bottom view of a single pluggable constant current module. The module 330A comprises a module circuit board 331A with attached polarized connector 332A. The module 330A plugs into a constant voltage source via the polarized connector 332A, so the module cannot be plugged in improperly. It includes a buck regulator for transforming a higher voltage to a lower voltage at a specific current defined by the combination of an onboard inductor, a resistor that sets the switching frequency, and a current sense resistor. The constant current module can be created with special circuitry to provide custom features such as soft start, different methods of dimming, or temperature compensated current.

Figure 4:
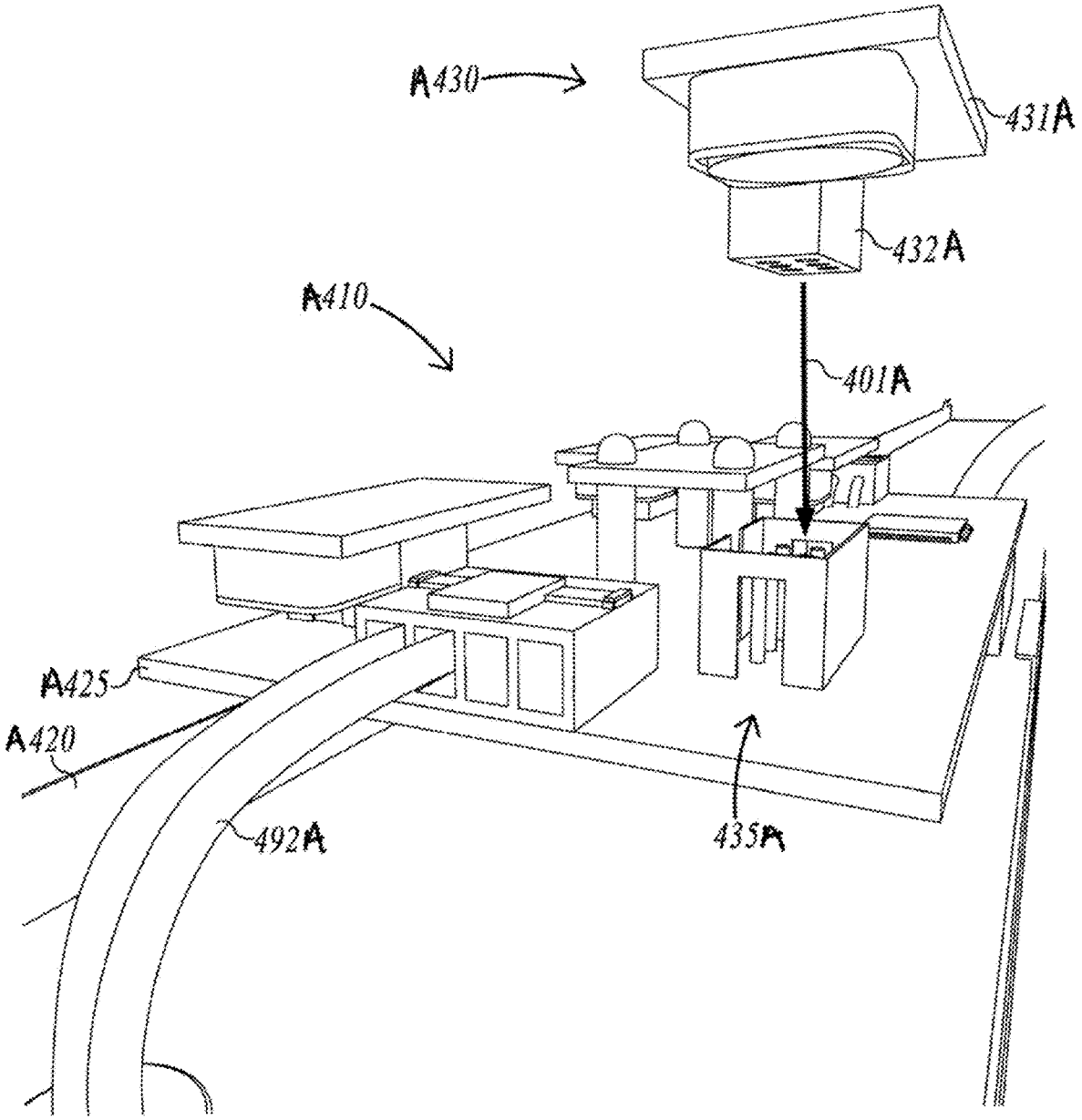
FIG. 4 illustrates a perspective view of the installation of a single pluggable constant current module.

FIG. 4 illustrates a perspective view of the installation of a single pluggable constant current module. The driver card with pluggable constant current module 410 is attached to the top cover A420 of a light fixture housing. It comprises a PCB A425 with a plurality of sockets 435A that each are capable of receiving a pluggable constant current module A430. The module A430 with module circuit board 431A and polarized connector 432A can be installed into a socket 435A with a downward push, as indicated by motion arrow 401A. Once fully installed and provided with a constant voltage, the module, or plurality of modules present on the PCB A425, output a constant current to the solid-state lighting elements via outgoing wire 492A. Multiple pluggable constant current modules can be used to independently provide constant current power to multiple strings of solid-state lighting elements, each of which can operate at a different, independent current level from the same constant voltage power source. An example would be operating different colored lighting elements where each color RGBW (red, green, blue and white) can operate at a different current level matching light levels (lumens) in a way that red is as bright as green or blue or white. Pluggable constant current modules also allow an array of solid-state lighting elements to operate at different maximum lighting levels without changing the number of solid-state lighting elements but rather altering the current levels. An example would be using a fixed number of LEDs to generate a maximum of 5,000 lumens of light with one module and using another module to limit the maximum output to 4,500 lumens with the same LEDs. Thus, whether for application changes or lumen maintenance reasons, an installer can modify light intensity indefinitely without having to replace the light fixture.

Thus, a light system comprising a light fixture housing, a driver card, and a constant current module removably coupled to the driver card is contemplated, wherein the constant current module is configured to receive a constant voltage from the driver card and produce a constant current. A plurality of LEDs can be coupled to the constant current module to thereby receive the constant current. It is contemplated that additional constant current modules can be added to modify the constant current to a second constant current. Alternatively, the constant current module can be replaced with a second constant current module to thereby produce a second constant current that is greater than or less than the constant current of the constant current module.

B. Light Fixture with Built-In Occupancy Sensor

Figure 5:
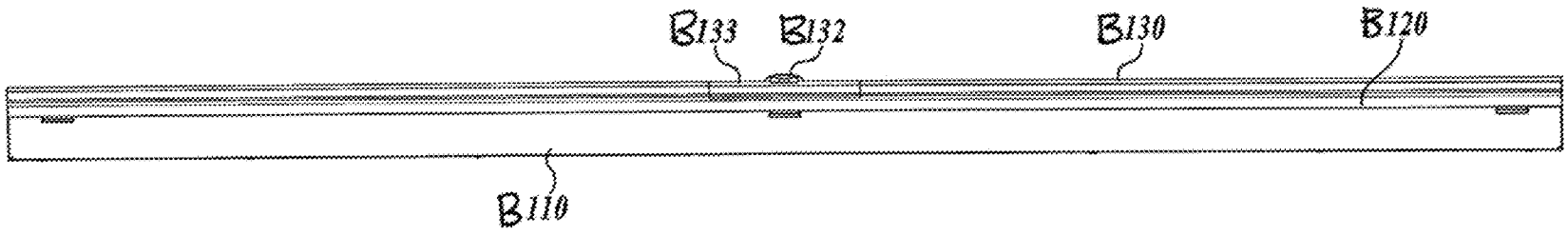
FIG. 5 illustrates a side view of a light fixture with built-in occupancy sensor.

FIG. 5 illustrates a side view of a light fixture with built-in occupancy sensor. An exemplary embodiment of the present invention provides a modified solid-state lighting device that conveniently and efficiently integrates a pyroelectric, passive infrared (PIR)-based occupancy sensor (see PIR-based occupancy sensor 305B of FIG. 7) into the fixture and, more particularly, into its power supply architecture and dimming control system. A preferred embodiment provides a sensor lens B132 that is physically mounted in the center of the light fixture. The bottom housing B110 of the fixture houses electronics and power supplies that simultaneously provide support for lighting elements and the occupancy sensor. It is fully enclosed via a top cover B120 that can be snapped into place via a tab/slot system, without the use of any tools. An optical lens B130 completes the fixture/enclosure by covering sensitive lighting elements within the fixture. Said lens is modified with an opening (see sensor opening B631 of FIG. 10), allowing operational access by the interior sensor. Additionally, a lens mounting bracket B133 covers a circumferential portion of the sensor lens B132 and locks it into place when fully installed onto the optical lens B130. The current figure indicates the low profile of the sensor lens B132, which is centered with respect to the length of the light fixture housing, and makes contact with the lighting surface—i.e. the optical lens B130. These physical characteristics minimize the requirement to install the sensor in a particular orientation, and subsequently minimize installation errors. The lens mounting bracket B133 allows for field replacement that can support a variety of different lenses and fields of view, while aesthetically treating the transition from fixture to sensor lens B132. The integrated sensor reduces installation time and cost.

Figure 6:
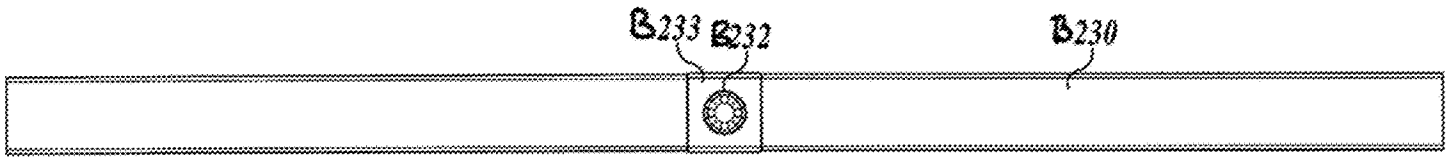
FIG. 6 illustrates a top view of the light fixture with built-in occupancy sensor of FIG. 5.

FIG. 6 illustrates a top view of the light fixture with built-in occupancy sensor. The occupancy sensor (see PIR-based occupancy sensor 305B of FIG. 7) is centered with respect to the length of the light fixture/optical lens B230, and with respect to the length and width of the lens mounting bracket B233, which is mountable upon the optical lens B230. The sensor lens B232 protrudes from an interior surface of the bracket B233, while its bottom circumferential surface makes contact with the optical lens B230. Ease of access and installation makes the sensor lens B232 field changeable to support a variety of lighting fixture mounting heights and variable occupancy detection area.

Figure 7:
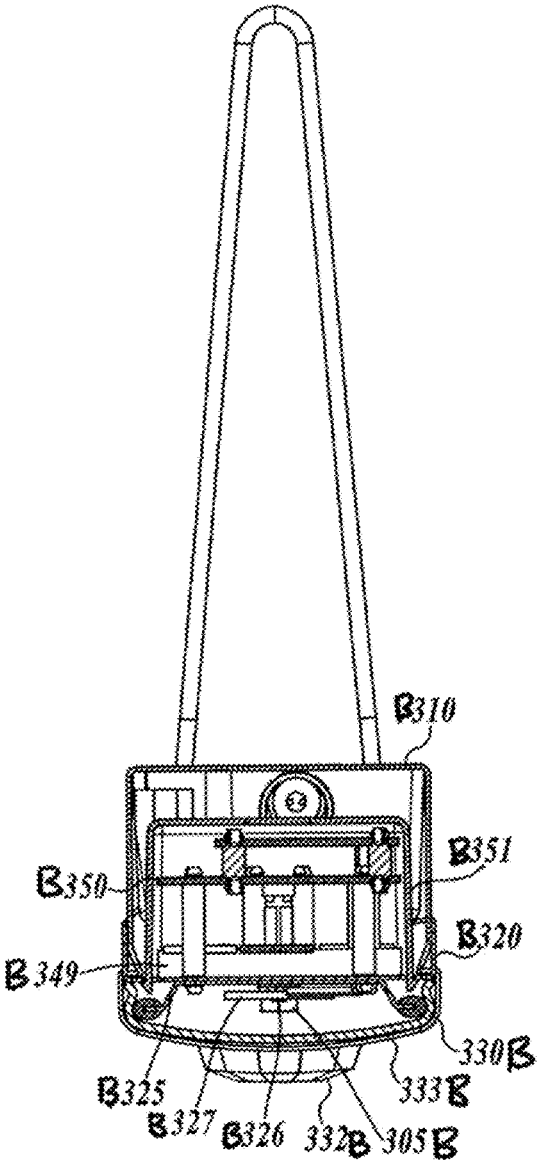
FIG. 7 illustrates an end view of the light fixture with built-in occupancy sensor of FIG. 5 showing interior components.

FIG. 7 illustrates an end view of a fully installed light fixture with built-in occupancy sensor and interior components. The present invention comprises a light fixture with bottom housing B310, top cover B320, and optical lens 330B. It further comprises interior lighting elements and electronic components, including a heat sink B325 with mounted led strip B327. A plurality of LEDs B326 line the top surface of said strip B327. Additionally, a driver card assembly B350 is installed within an interior electronics housing B351 via an electronics mounting element B349. Said mounting element attaches to a bottom surface of the heat sink B325 and/or supplementary mounting element. A PIR-based occupancy sensor 305B is integrated into the interior electronics and attains occupancy information through the sensor lens 332B below. The lens mounting bracket 333B covers a center portion of the optical lens 330B from edge to edge, thereby obscuring the optical lens surface at its mounting location. In a preferred embodiment, said bracket conforms to the curved shape of the optical lens 330B, for a secure fit that is also aesthetically formed. Terminal edges of the bracket 333B that extend downward toward the bottom housing B310 can terminate within the fixture via slots found on the top cover B320. The sensor lens 332B sits within the bracket 333B, centered within it and protruding from it. A circumferential bottom portion of the sensor lens 332B sits above the lens assembly (see lens assembly B615 of FIG. 10), so that it makes contact with the optical lens 330B, and extends upward through the lens mounting bracket 333B.

Figure 8:
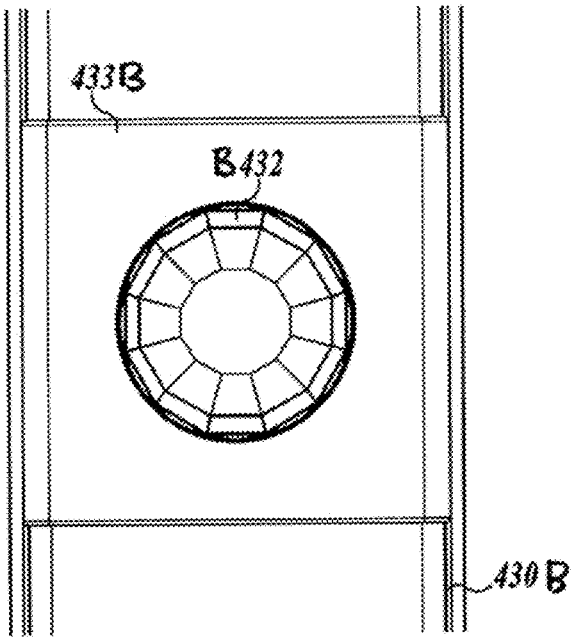
FIG. 8 illustrates a close-up top view of the sensor lens and mounting bracket.

FIG. 8 illustrates a close-up top view of the sensor lens and mounting bracket. The bracket 433B is mounted directly onto the optical lens 430B, and locks the sensor lens B432 in place when fully installed. A centered sensor allows for ease of access and installation, as well as giving attention to aesthetic qualities. The sensor lens B432 can be a Fresnel-type lens that is field-changeable to support variable mounting heights and sensor detection areas. The mounting bracket can be fabricated from a variety of different materials, including stainless steel, aluminum, and copper. The finish can be brushed metal, anodized, or powder-coated to add aesthetic properties.

Figure 9:
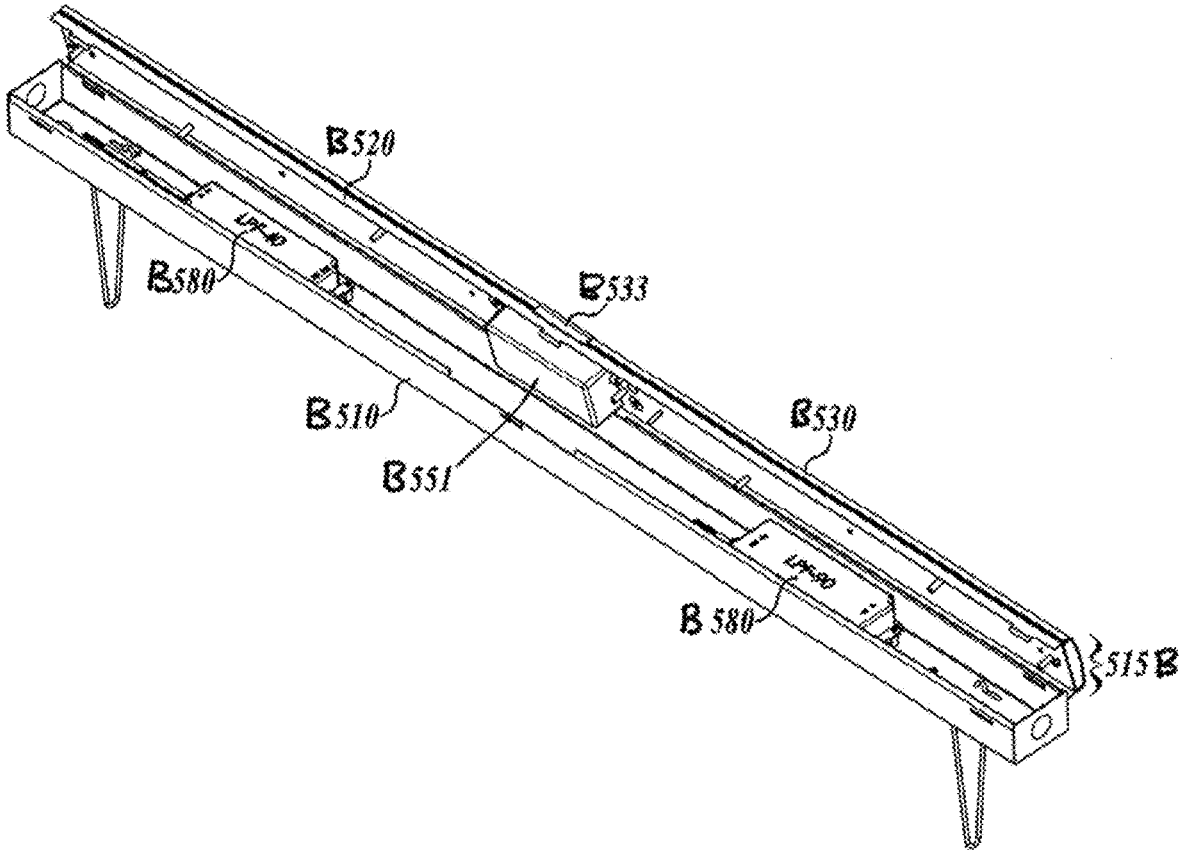
FIG. 9 illustrates a perspective view of the light fixture of FIG. 5 with partially opened top cover.

FIG. 9 illustrates a perspective view of the light fixture with partially opened top cover B520, highlighting a plurality of power supplies B580 found within the bottom housing B510. The top cover B520, part of a lens assembly 515B with optical lens B530 and lens mounting bracket B533, has the electronics housing B551 mounted to an interior surface of its center region. Said housing secures and protects various electronic components, including a driver card assembly (see driver card assembly B650 of FIG. 10) with printed circuit board (PCB) and microcontroller (MCU) having various software algorithms necessary for sensor communication and power distribution. The electronics associated with the occupancy sensor are implemented with the light fixture driver, no additional power supply stage is required, and no additional housing or associated fastener is required to support the occupancy sensor equipment. Said electronics provide the advantage of combining the power stage for the sensor and lighting electronics. The present invention is capable of providing efficient operating power shared between the occupancy sensor and light fixture, and any associated PCB resources thereof. Additionally, said software algorithms supported by the MCU can be modified in the field to support a variety of control methods—whether autonomous, or part of a larger array of a lighting control system.

Figure 10:
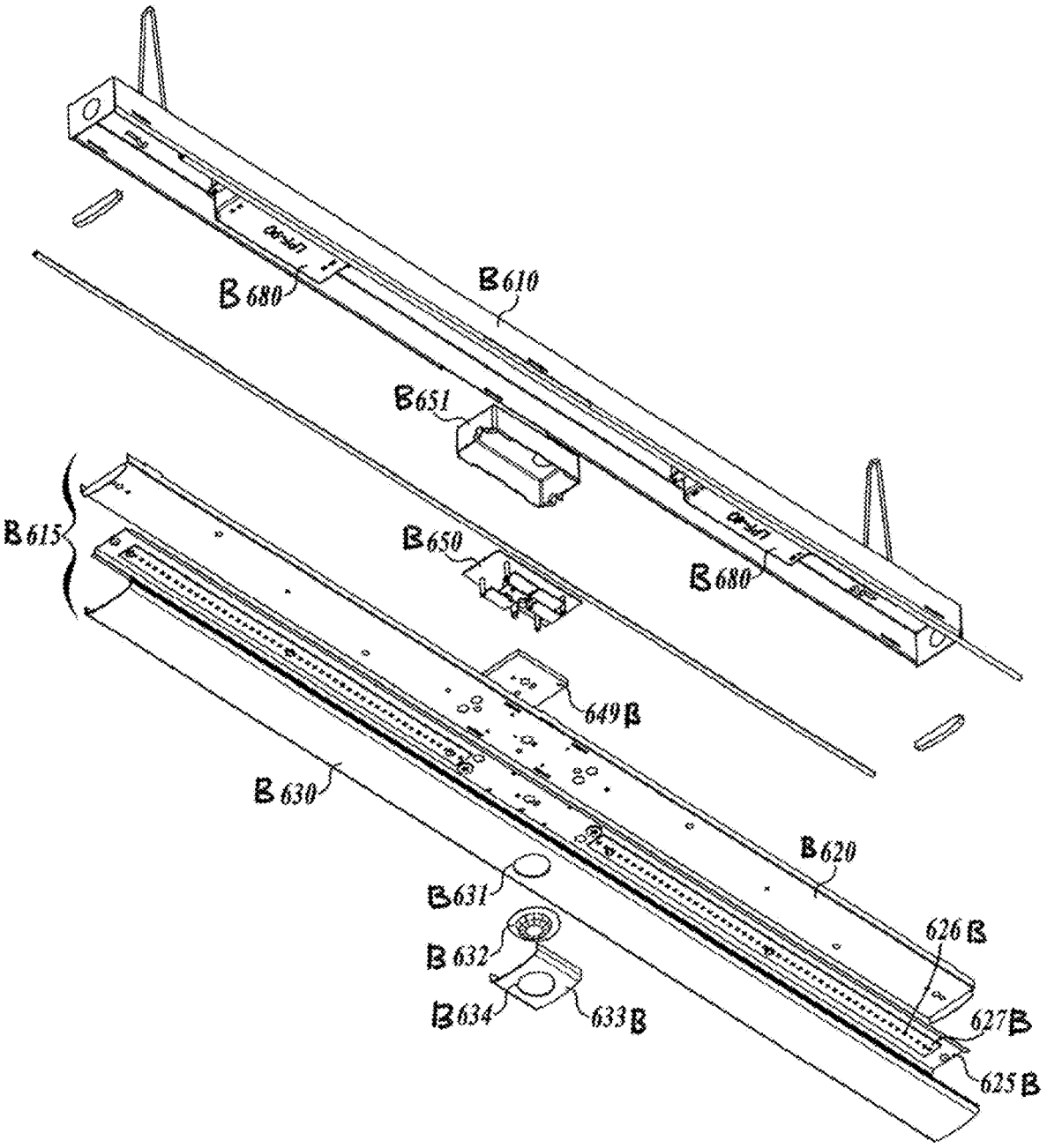
FIG. 10 illustrates an exploded view of the light fixture with built-in occupancy sensor of FIG. 5.

FIG. 10 illustrates an exploded view of the light fixture with built-in occupancy sensor. It provides a light fixture comprising a bottom housing B610 with one or more power supplies B680 installed within its interior, and a lens assembly B615. Said lens assembly further comprises a top cover B620, optical lens B630, and heat sink 625B with attached LED strip 627B having LED lights 626B. A driver card assembly B650 with sensor/light electronics sits within an electronics housing B651. Said housing is mounted to the heat sink B620 via the mounting element 649B. A sensor opening B631 placed through the optical lens B630 ensures an unobstructed portal between interior electronic/power elements and sensor lens B632—which sits upon the optical lens B630 via a circumferential extension. The sensor lens B632 is held in place by the lens mounting bracket 633B placed over said circumferential extension, with its Fresnel lens portion protruding through a bracket opening B634 found in the center of the mounting bracket 633B. The occupancy sensor (see PIR-based occupancy sensor 305B of FIG. 7) and its associated electronics share a driver card assembly B650 with the lighting element; no additional power stage is required for its operation. All electronics are integrated into the lighting fixture and optimized to minimize power consumption.

Thus, a light fixture comprising an occupancy sensor is contemplated. The light fixture typically further comprises a control system configured to control a light intensity of a light. The occupancy sensor is preferably coupled to the control system. In some embodiments, the occupancy sensor is coupled to a center of the light fixture.

C. Push-In Power Connector System

Figure 11:
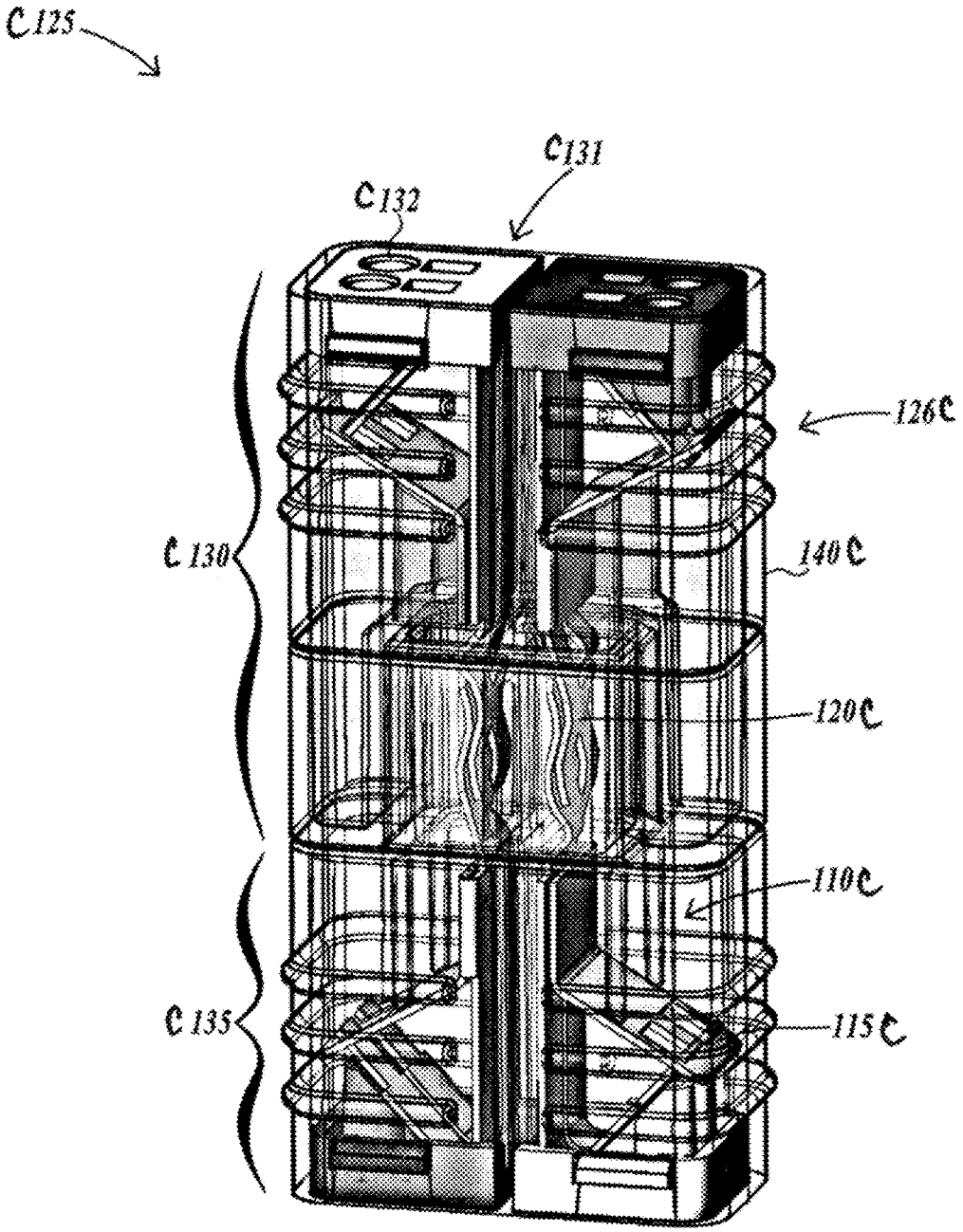
FIG. 11 illustrates a perspective view of the push-in power connector system.

FIG. 11 illustrates a perspective view of the push-in power connector system. An exemplary embodiment of the present invention includes an electrically insulated plug/socket enclosure C125 formed by uniting a female housing C130 with a male housing C135—each housing further comprising a pair of electrically isolated contact poles 126C. As well, the terminal portion (that portion opposite the mating end) of each housing is occupied by color-coded caps C131 with wire ports C132. The interior of the mated enclosure C125 includes a plurality of compartment walls 140C which serve to electrically isolate each of the four poles 126C from one another. Said walls run vertically to separate two adjacent poles 126C within a common housing, and horizontally to separate two adjacent poles 126C in different housings. Thus, the poles 126C are shielded not only to the exterior of the housing, but also from any internal shorting paths. Each contact pole 126C comprises a hermaphroditic contact 110C with push-in receptacle 115C and electrical terminals 120C. An exemplary embodiment of the present invention includes two terminals 120C per hermaphroditic contact 110C. All four contacts 110C are identical, and shielded at both ends, whether the housings are engaged or disengaged. Each pair of terminals 120C engages with those of the mated housing, thereby electrically connecting poles 126C lying on the same vertical axis. Bare conductive wires can be pushed into wire ports C132 to engage the push-in receptacle 115C of each hermaphroditic contact 110C—which flexibly locks the inserted wires in place within the enclosure C125. The flow of electricity is thus carried from said wire to said contact 110C and across mated housings. A range of wire sizes and types can be utilized with the present invention. Solid or stranded wire from 12 AWG to 18 AWG can be used. The housings have built into them a deflection limiter that prevents a large wire size from flexing a push-in receptacle 115C past its elastic limit. The housings also include compartments which constrain the final location of inserted conductive wires. This limits movement of the wire within the enclosure C125. The pluggable male and female housings can be releasably mated with one another to allow or disallow electrical current from flowing through the joinable terminals 120C.

The push-in power connector can be used in any electrical circuit where quick, convenient, and replaceable connections to the circuit are desirable. It is particularly suited for the quick and safe connection and disconnection of power sources. Both non-conductive housings cover the current-carrying contacts 110C in a manner that disallows human fingers from coming into contact with them. Each housing can support two or three poles 126C, with one to four stripped wire contacts, or one to six stripped wire contacts, respectively. In a preferred embodiment, housing caps C131 are color-coded based on wire jacket color. This is dictated by color standards such as red and black ("+" and "−", respectively) for direct current (DC) power, brown and blue ("Line" and "Neutral", respectively) for international alternating current (AC) power, black and white ("Line" and "Neutral", respectively) for US alternating current (AC) power, and green for protective ground. Each housing can optionally be mounted and/or electrically connected to a printed circuit board (PCB) in either a horizontal or vertical orientation. If necessary, the connector housing can be fabricated at a size that allows it to pass through a half-inch conduit.

Figure 12:
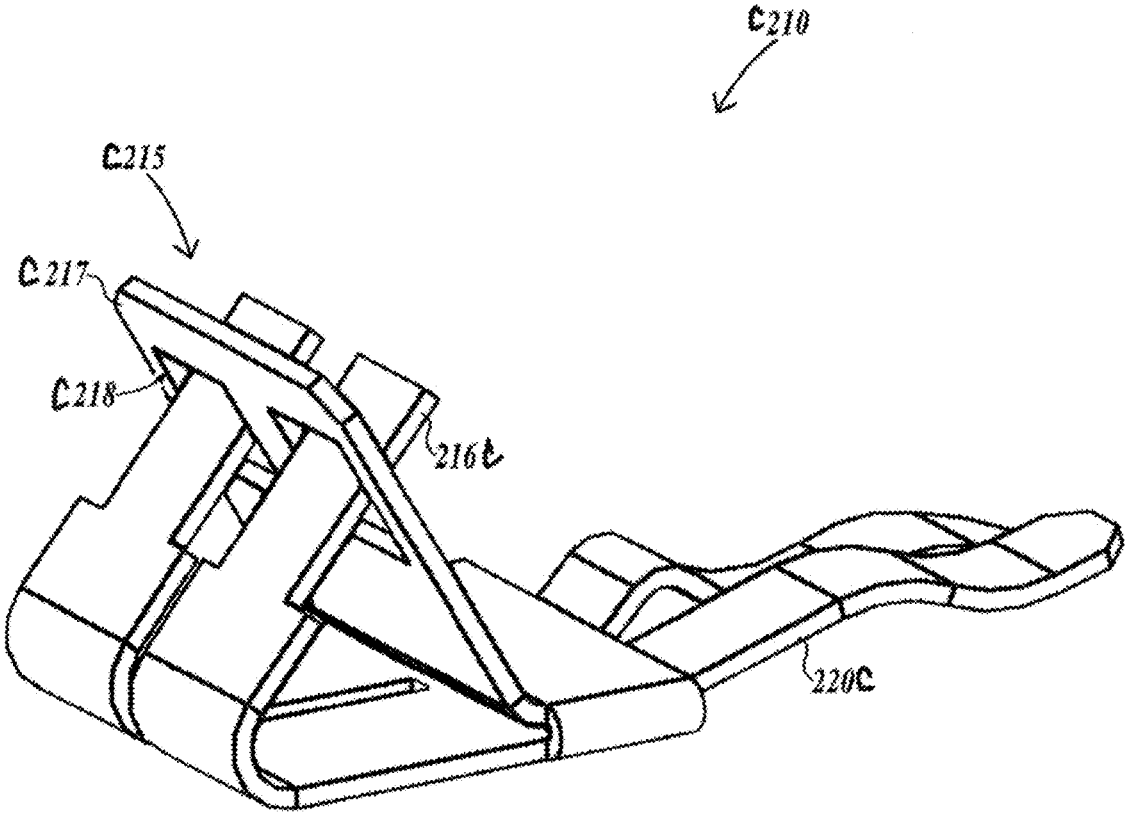
FIG. 12 illustrates a perspective view of the hermaphroditic contact.

FIG. 12 illustrates a perspective view of the hermaphroditic contact. A plurality of identical hermaphroditic contacts C210 are utilized for the push-in power connector system. Each contact C210 is a single piece of electrically conductive material formed to provide electrical terminals 220C at one end and an integrally-formed push-in receptacle C215 at the other end. Said receptacle portion further comprises flexible prongs 216C and a mating extension C217 with slots C218. Said prongs 216C enter and protrude from the mating extension C217 via its slots C218. The hermaphroditic contact C210 is configured to accept and engage with a variety of conductive stripped wire at its push-in receptacle C215, responding with a flexing action by said prongs 216C. Incoming wire can enter slots C218 (in the same manner as the prongs 216C), push the prongs diagonally downward, protrude on the other side, then be locked into the receptacle C215 as the prongs 216C return diagonally upward. Current carried by the incoming wire is transferred into the hermaphroditic contact C210 and introduced into a fully installed push-in power connector system. Each of the four internal contacts provides 2 external contacts via a copper hermaphroditic connector, making each of the four electrical contacts identical.

Figure 13:
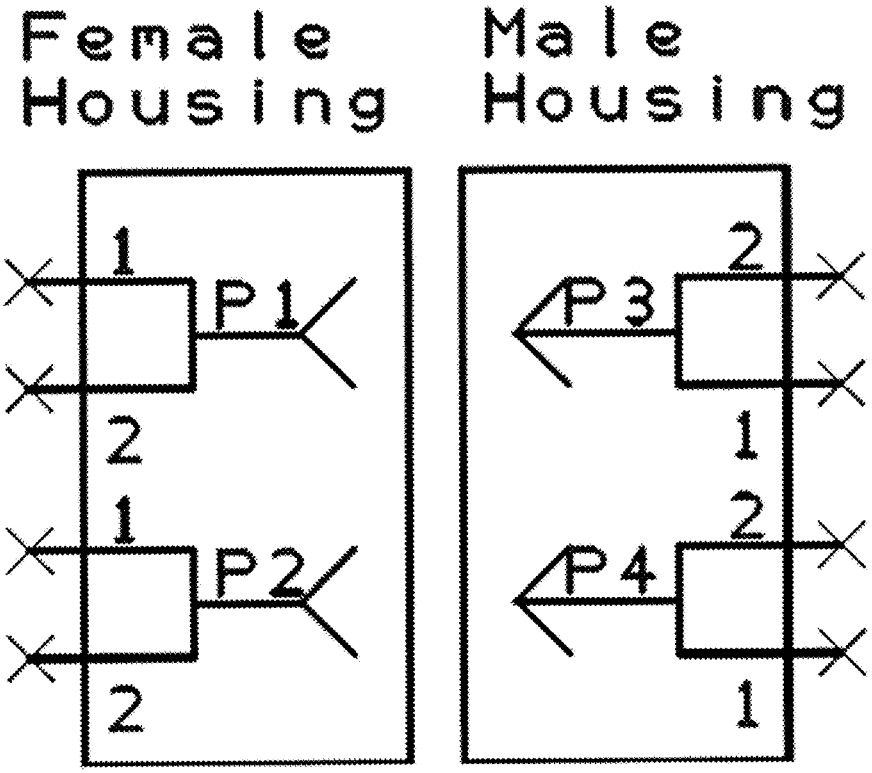
FIG. 13 illustrates a diagram describing the power exchange between male and female portions of the push-in power connector system.

FIG. 13 illustrates a diagram describing the power exchange between male and female portions of the push-in power connector system. Direct electrical contact occurs between poles one and three, and between poles 2 and 4.

Thus, connector systems comprising a male housing and female housing are contemplated. The male and female housings are removably coupled and each typically comprises a hermaphroditic contact disposed on one end of each of the housings. It is contemplated that the hermaphroditic contact comprises electrically conductive materials such that an electrical coupling is provided when the male and female housings are coupled.

D. Remote Power Distribution Unit with Bi-Directional Communication

Figure 14:
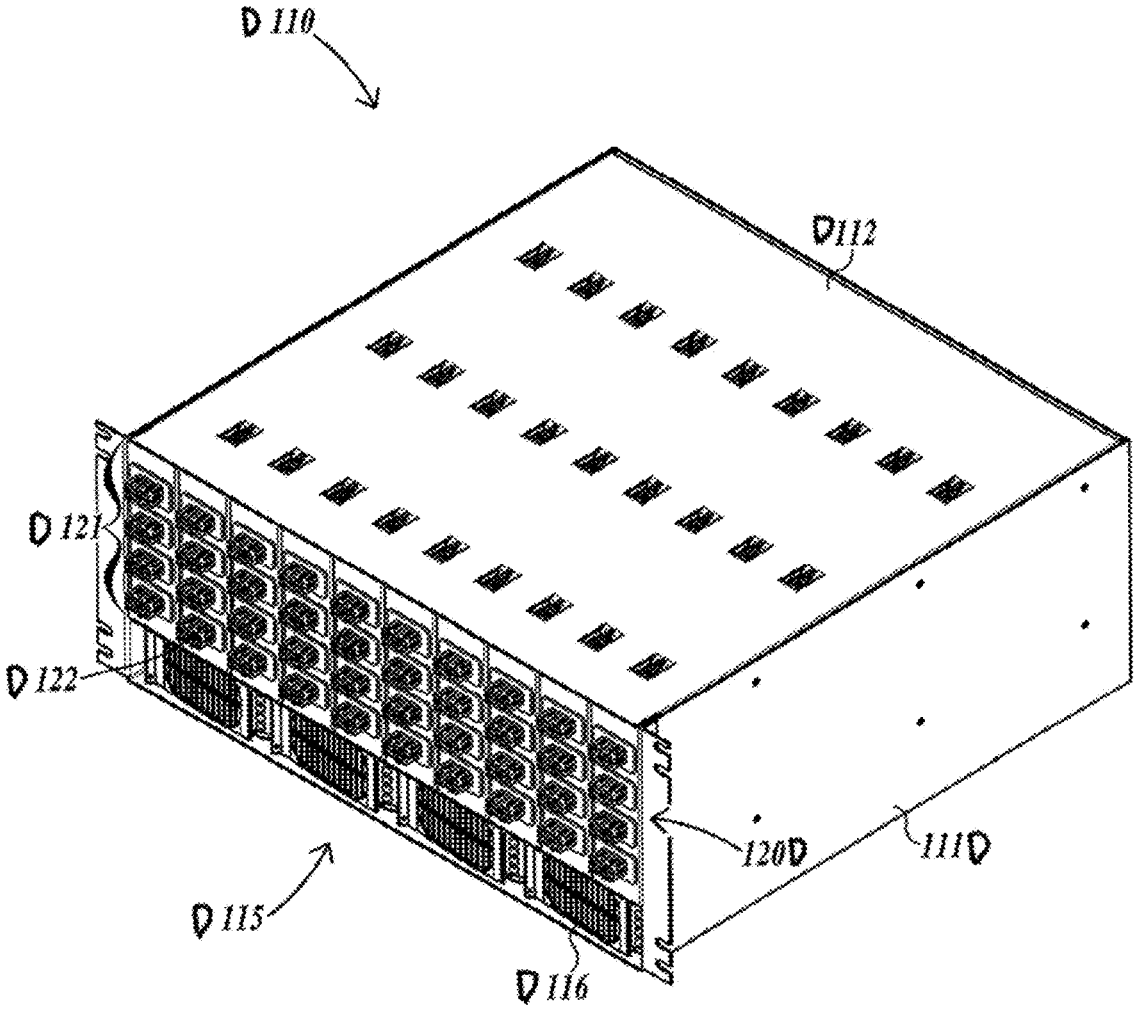
FIG. 14 illustrates a perspective view of a remote power distribution unit.

FIG. 14 illustrates a perspective view of a remote power distribution unit. The present invention consists of a size 4U (7" H×19" W×16" D) rack-mount chassis D110 which houses a set of host power supplies D116. It separately provides a light fixture (or plurality of light fixtures) having an ambient light sensor, an occupancy light sensor and a control system that adjusts the light output of the solid-state light-emitting elements based on the sensed ambient light and on a sensed occupancy level of a sensed area around the light fixture. The present invention provides a multitude of advantages by removing power supplies from light fixture housings and remotely placing them in a dedicated control center, or host. The rack-mount chassis D110 is a rectangular enclosure comprising a top lid D112 and primary housing 111D. The frontal face of the primary housing comprises a size 3U (5.25" H) upper portion 120D and a size 1U (1.75" H) lower portion D115. The lower portion comprises a plurality of high efficiency power supplies D116, while the upper portion comprises an array of four port modules D121 with slave ports D122. In a preferred embodiment, each slave port D122 is connected to a different solid-state lighting device via a single pair of wires. Each of the plurality of ports can simultaneously supply up to 168 watts per port. Each wire pair provides a dedicated bi-directional communication signal that rides on the direct current (DC) voltage, creating an independent link between the host and each slave (solid-state lighting device). Said bi-directional communication system can be implemented by Power Line Communication (PLC) protocol, or other appropriate protocol. Power supplies D116 are capable of converting AC power to DC power that is delivered to the array of slave ports D122 and connected lighting devices. This conversion occurs at 96.5% efficiency. With a typical cable voltage drop efficiency of 1.5%, the net power conversion efficiency is still 5% superior to typical onboard power supplies, which run at approximately 90% efficiency. In a preferred embodiment, the rack-mount chassis will house between two and four high efficiency AC/DC power supplies, and supports redundant, hot-swappable power at a safer distribution voltage. With remotely located power supplies, an additional benefit is removing a heat-generating source from a light fixture, which means the lighting elements will operate at higher efficiencies and generate less heat. The power supplies for the lighting infrastructure can be relocated to an area where ventilating the heat can be handled in a more effective manner. Consequently, the set of common power supplies can be arranged to support redundancy and hot swap functionality, which means the concept of a light failure is minimized and failed power supplies can be replaced without turning the power off or climbing ladders to reach failed devices.

The host control system can also receive a control signal from a central location that monitors a total peak energy use by the building or location in which a light fixture is located. In response to this signal, the host can modify the light output, and/or turn on or off, the solid-state lamps when the overall energy use rises too high or falls back down from a peak energy use period. While leveraging the efficiencies of various technologies, moving the power supply from the light fixture to a common area, the most powerful method of saving energy is to turn the lights off when they are not needed. To this end, a bi-directional communication link between each individual light fixture and a host controller offers the greatest savings.

Figure 15:
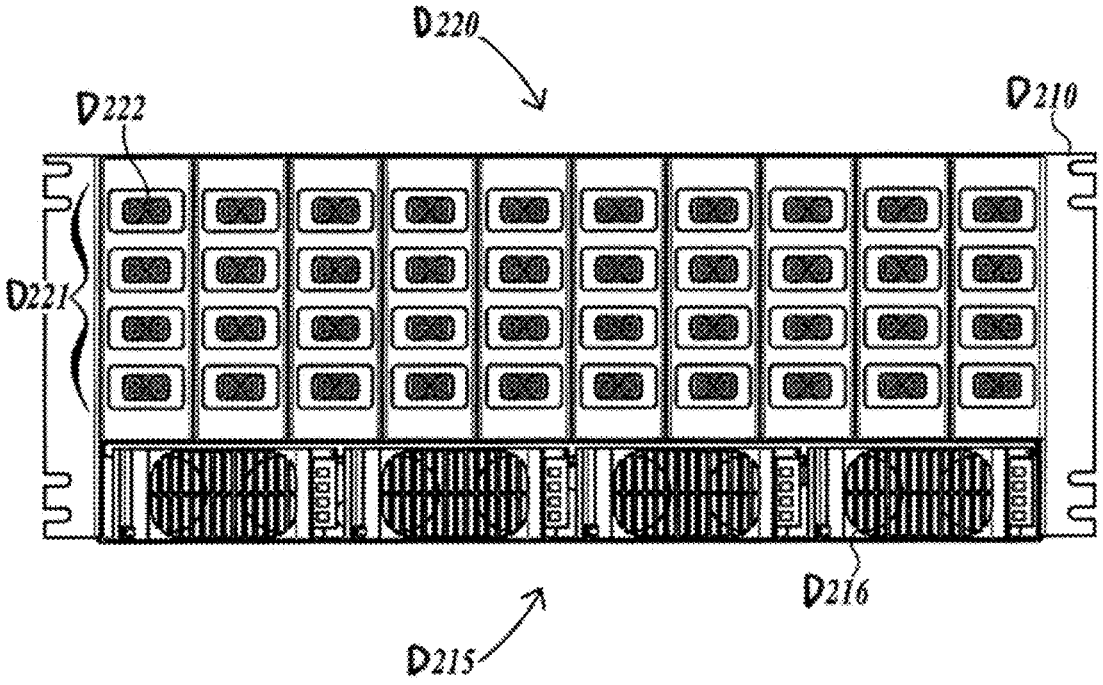
FIG. 15 illustrates a frontal view of a remote power distribution unit.

FIG. 15 illustrates a frontal view of a remote power distribution unit. The rack-mount chassis D210 comprises a frontal face with upper portion D220 and lower portion D215. The upper portion D220 further comprises an array of four port modules D221 with slave ports D222. The lower portion D215 further comprises a plurality of power supplies D216. The chassis D210 is built to safely and uniformly dissipate heat through strategically placed slits and/or gratings in its architecture. This function is handled much more efficiently by a dedicated remote host, and as a consequence, multiple heat-generating elements can operate safely and efficiently within the enclosure. Moreover, there is no need for AC/DC power supplies or conversion in the separate light fixture. This reduces heat generated in the light fixture, thereby increasing efficiency for LED lighting elements and reducing air conditioning requirements for the environment. Conveniently, the weight of a light fixture is significantly lower without a power supply or supplies installed within the fixture. Additionally, the use of low voltage direct current (DC) to power lighting devices is itself a valuable safety feature, as it results in a system that is safer in regards to human safety and fire safety.

Figure 16:
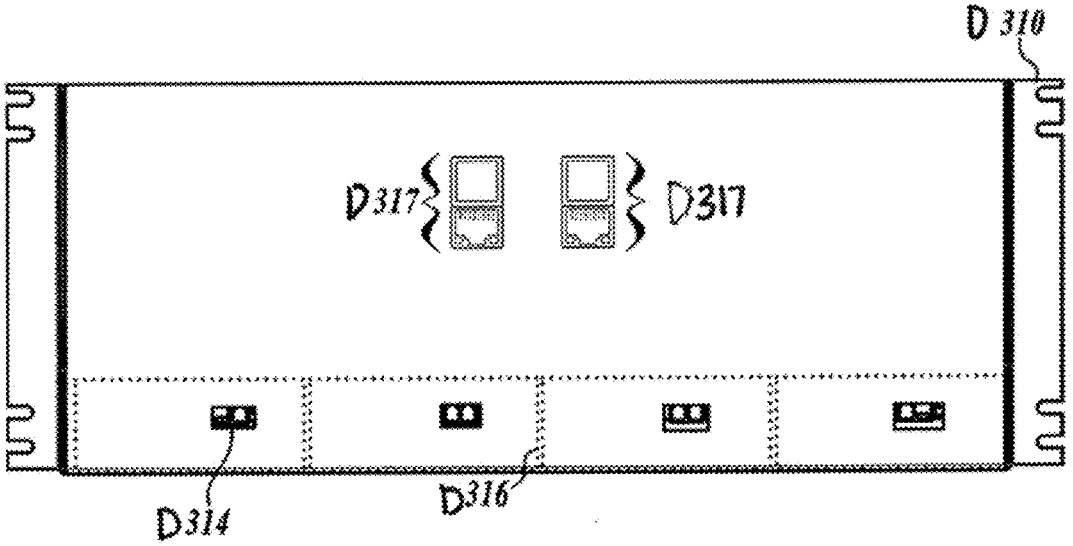
FIG. 16 illustrates a rear view of a remote power distribution unit.

FIG. 16 illustrates a rear view of a remote power distribution unit. The rear facade of the rack-mount chassis D310 includes AC power inlets D314 by which AC power from a wall outlet or electrical box can be introduced into the host system. Connected AC power plugs will deliver a high voltage to the interior power supply D316, which will then convert it into low-voltage DC power that can be distributed the array of slave ports (see slave ports D222 of FIG. 15) in the upper portion of the chassis. A single remote power distribution unit is capable of powering and controlling over 50 light fixtures. Communication with a lighting device is provided by a signal riding on top of said DC power, and does not require additional wired or wireless connections to the lighting fixture. A motherboard (see motherboard D425 of FIG. 17) within each host unit provides for network connectivity. Accordingly, a plurality of MCU/LAN (Local Area Network) ports D317 are available on the chassis D310. Said redundant MCU/LAN ports D317 allow connectivity to computers, wireless access points, mobile devices, and the Internet. With this functionality, host power supplies can be distributed into a larger area network. The result is an expansive realm of intelligent lighting with many different options for enhancement and efficiency.

Figure 17:
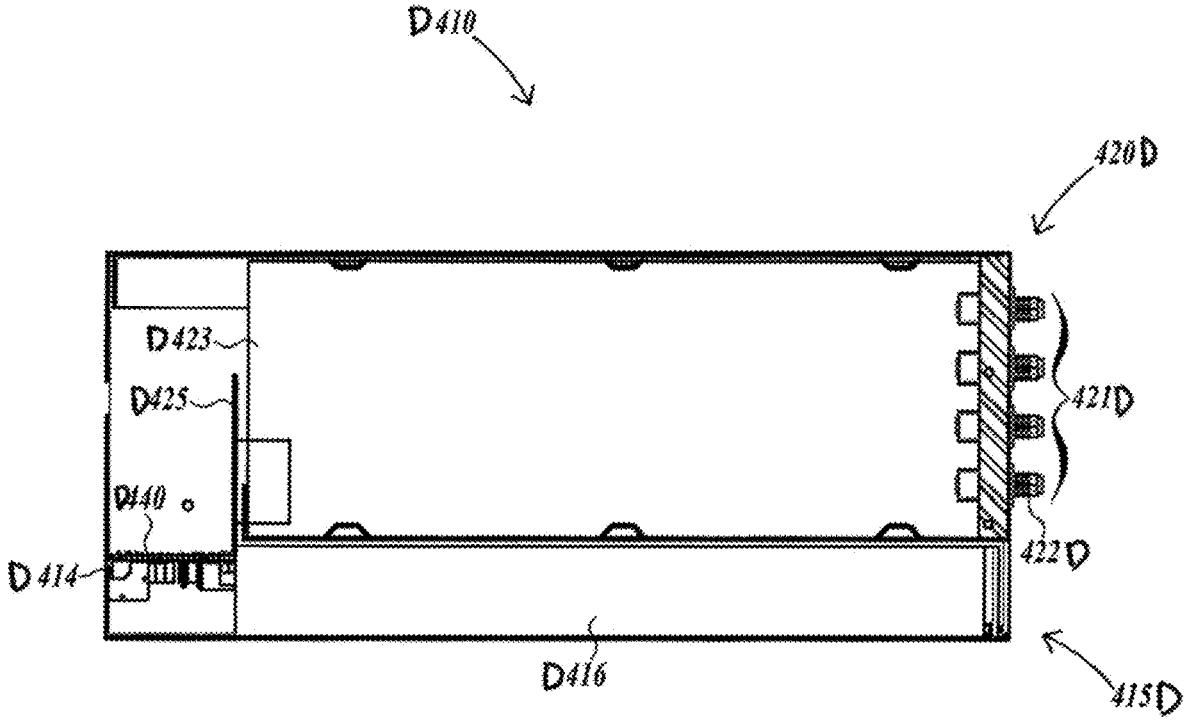
FIG. 17 illustrates a side view of a remote power distribution unit.

FIG. 17 illustrates a side view of a remote power distribution unit. It comprises rack-mount chassis D410 with upper portion 420D and lower portion 415D accessible at the frontal face. Said upper portion 420D further comprises a plurality of four port modules 421D, with slave ports 422D. Said lower portion 415D further comprises a set of AC/DC power supplies D416. At a rear interior region of the chassis D410, connected to the rear of said power supplies D416, lies a power interface card D440. At the rear of said card lies the plurality of AC power inlets D414—with one inlet per power supply D416. Extending perpendicularly upward from the interface card D440, on the side opposite the power inlets D414, lies a motherboard D425. Said motherboard connects to a plurality of line cards D423, which extend forward from the motherboard and terminate in the plurality of four port modules 421D. There is one line card D423 connected to each four port module 421D. Each slave port 422D can have a panel mount disconnect on its connected line card D423. Additionally, the single pair of wires connected to each slave port can be augmented by a second, third, and fourth pair of wires, and the bi-directional communication system can thus be implemented by 4-pair Power over Ethernet (4-pair PoE). In another embodiment, instead of receiving AC power via the inlets D414, the power supplies D416 can be configured to receive DC power input. Additionally, said incoming DC power can be generated via solar technology.

Figure 18:
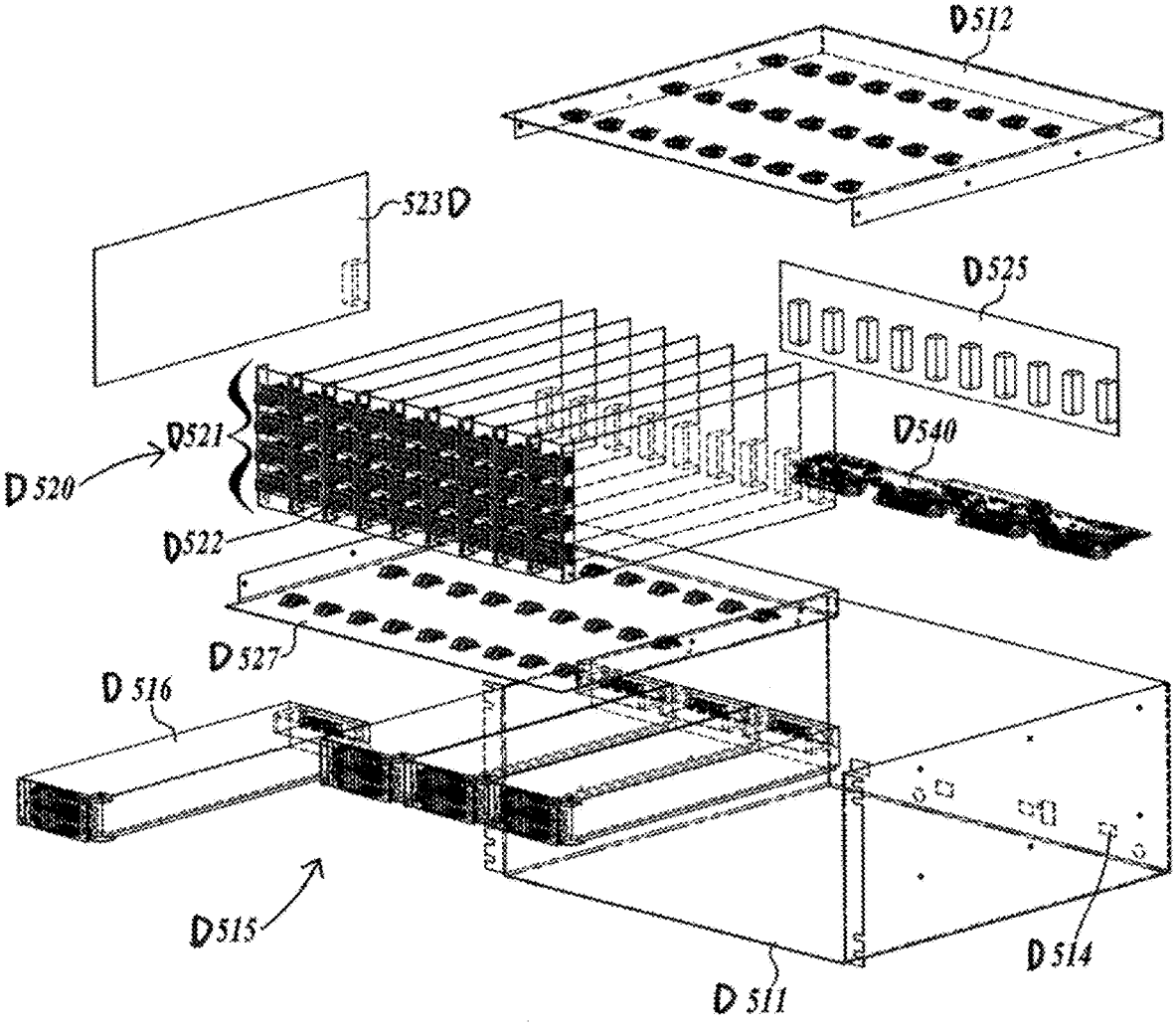
FIG. 18 illustrates a perspective exploded view of a remote power distribution unit.

FIG. 18 illustrates a perspective exploded view of a remote power distribution unit. To better inform the viewer about structural nuances and offset the effects of poor viewing angles, certain structures are shown as transparent—especially those which obscure elements closer to the background and/or internal components. The remote power distribution unit comprises a top lid D512 which sits over top a primary housing D511. A rear portion of said housing contains slots that serve as AC power inlets D514. A lower portion D515 sitting within the primary housing D511 comprises AC/DC power supplies D516. An upper portion D520 sitting directly above said lower portion D515 comprises an array of four port modules D521, each with four slave ports D522. Extending backward from said array are a row of line cards 523D, each line card connecting with a module D521. Said upper portion D520 and lower portion D515 are rack-mountable structures that can be secured within the primary housing D511, and are separated by an interior base panel D527 with substantial ventilation qualities. The terminal ends (those ends opposite the modules D521) of the line cards 523D meet and connect with the motherboard D525 via standard connective components. As well, the terminal ends of the power supplies D516 meet and connect with the power interface card D540 via methods known in the art. Two to four high efficiency AC/DC power supplies may be utilized. The remote power distribution unit supports redundant, hot-swappable power at a safer distribution voltage. Its modular nature allows for ease of modification, repair, relocation, etc—all while continuously, remotely supporting the power needs and functional characteristics of a plurality of lighting devices.

Figure 19:
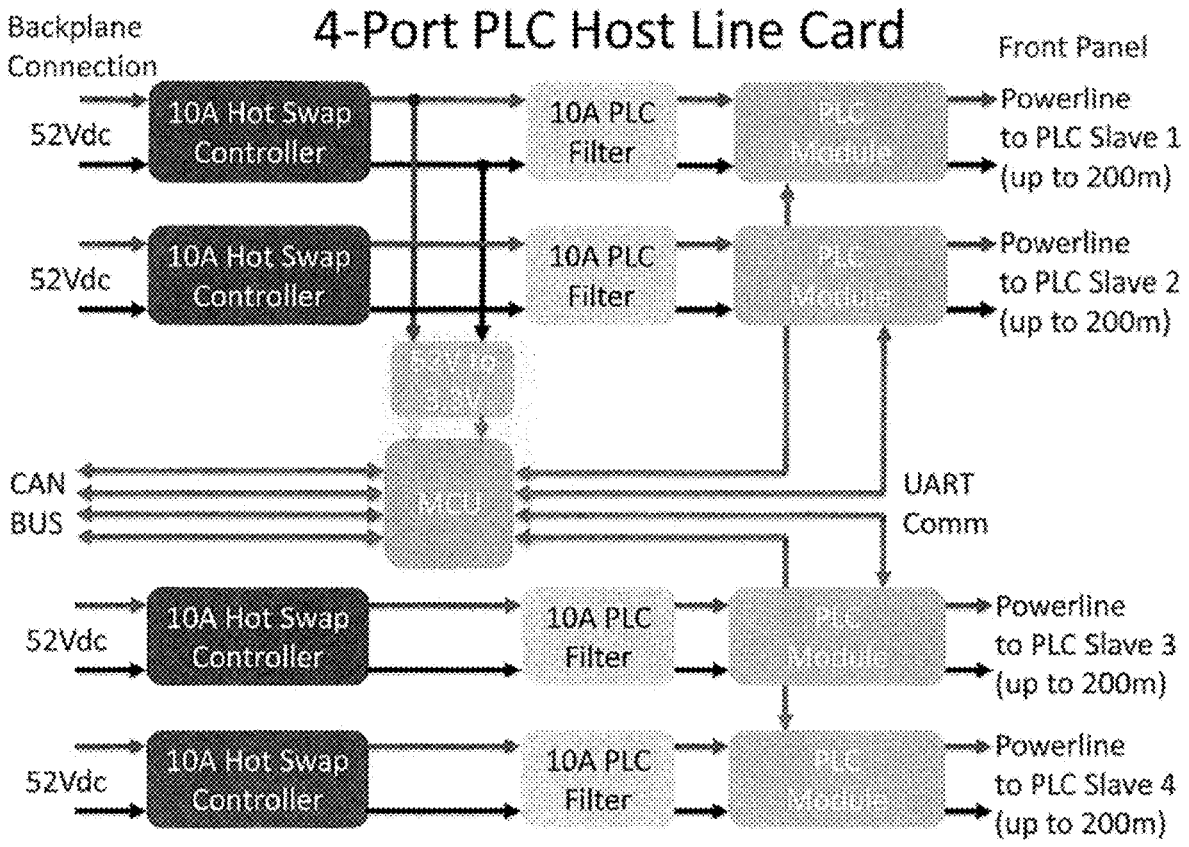
FIG. 19 illustrates a diagram describing power/communication signals for a 4-port PLC host line card.

FIG. 19 illustrates a diagram describing power/communication signals for a 4-port PLC host line card.

Figure 20:
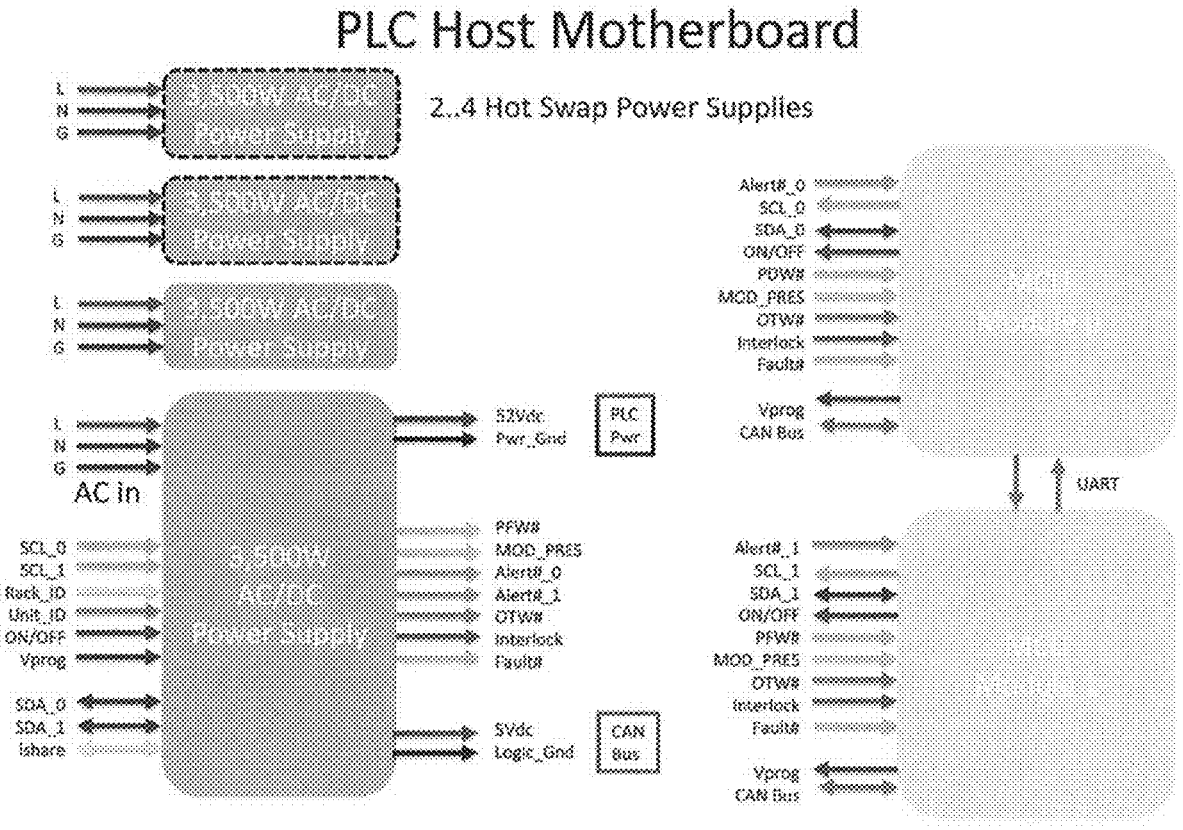
FIG. 20 illustrates a diagram describing power/communication signals for a PLC host motherboard.

FIG. 20 illustrates a diagram describing power/communication signals for a PLC host motherboard.

Figure 21:
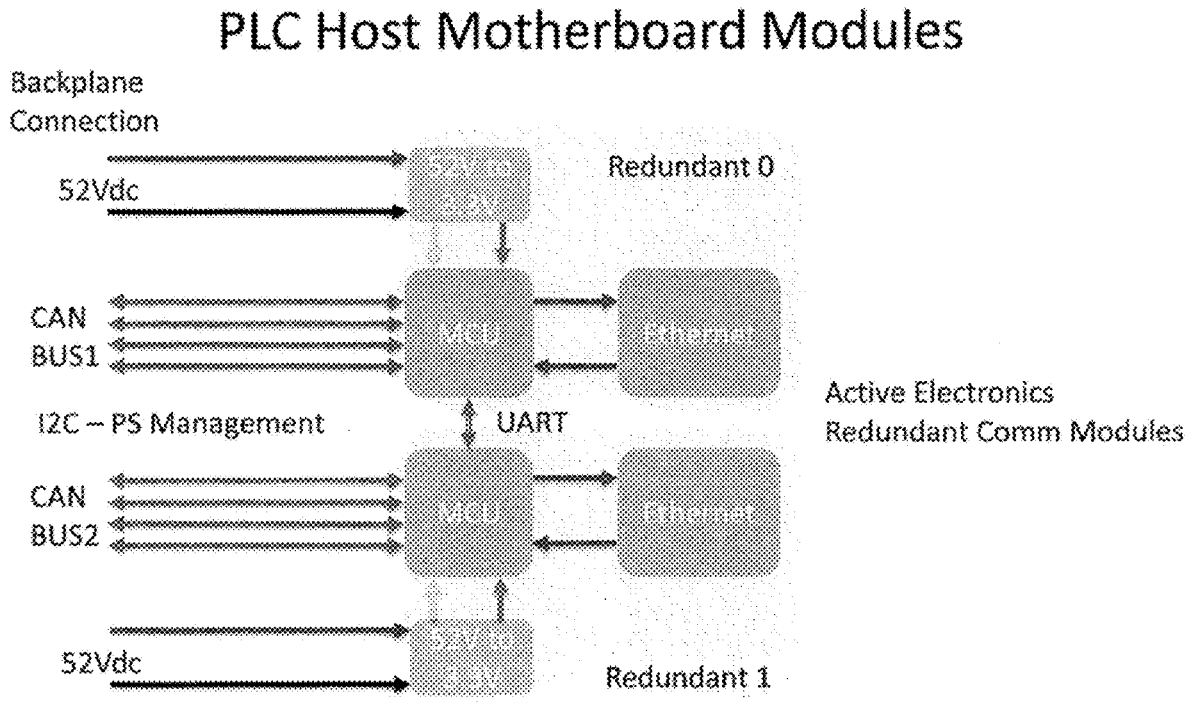
FIG. 21 illustrates a diagram describing power/communication signals for PLC host motherboard modules.

FIG. 21 illustrates a diagram describing power/communication signals for PLC host motherboard modules.

Figure 22:
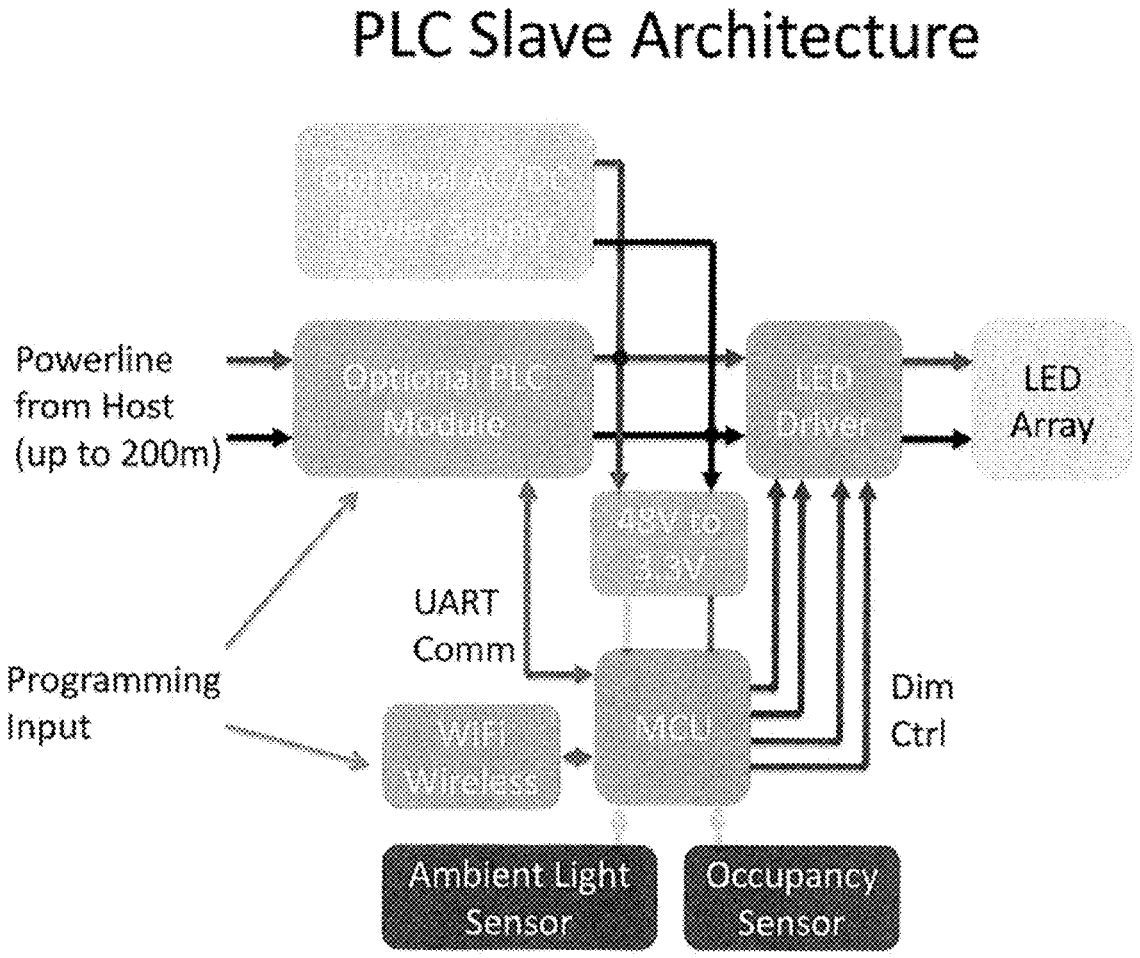
FIG. 22 illustrates a diagram describing power/communication signals for PLC slave architecture with WiFi wireless.

FIG. 22 illustrates a diagram describing power/communication signals for PLC slave architecture with WiFi wireless.

Figure 23:
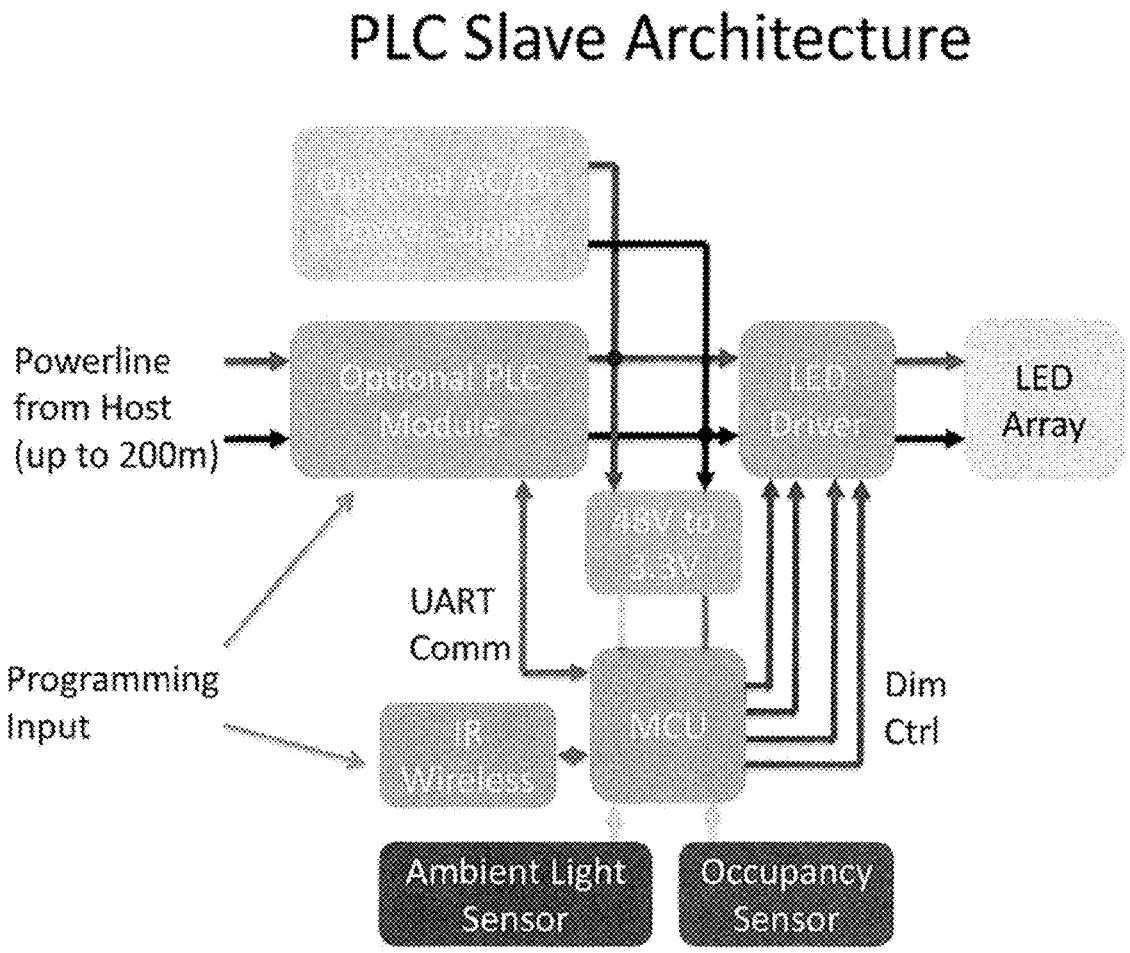
FIG. 23 illustrates a diagram describing power/communication signals for PLC slave architecture with IR wireless.

FIG. 23 illustrates a diagram describing power/communication signals for PLC slave architecture with IR wireless.

Thus, a lighting system comprising a light fixture and a remote power supply coupled to the light fixture is contemplated. The light fixture can comprise an ambient light sensor, an occupancy light sensor and a control system that adjusts the light output of the solid-state light-emitting elements based on a sensed ambient light and on a sensed occupancy level of a sensed area around the light fixture. The system can further comprise a control system that is configured to receive a control signal from a central location that monitors a total peak energy use by the building or location in which a light fixture is located, and thereby modify the light output, and/or turn on or off, the solid-state lamps when the overall energy use rises too high or falls back down from a peak energy use period.

E. Reverse-Mounted Lighting Assembly with Sealed Enclosure

Figure 24:
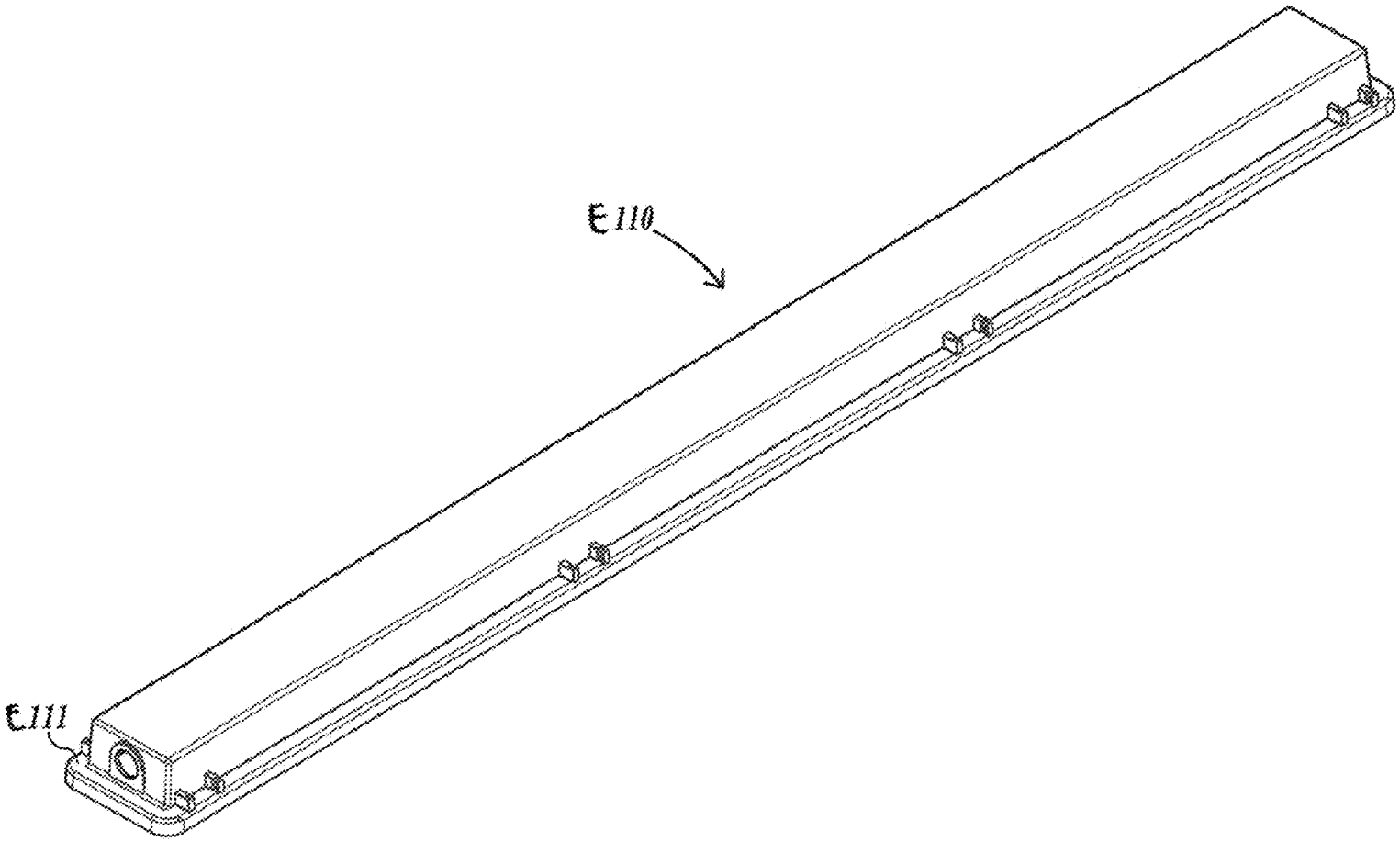
FIG. 24 illustrates a perspective bottom view of a reverse-mounted lighting assembly with sealed enclosure.

FIG. 24 illustrates a perspective bottom view of a reverse-mounted lighting assembly with sealed enclosure. In the following description, the term "fixture" may be used to broadly describe the underlying structure or housing associated with a preferred embodiment of the present invention. The current figure shows an orientation of said fixture in an installed state (albeit without a mounting mechanism), whereby light emanates from a top surface (that surface facing away from the viewer in FIG. 24) of the lighting device. The present invention offers a reversed or "upside-down" method of mounting a lighting assembly within a lighting fixture, via which said assembly sits within an upper portion of the fixture, rather than a lower housing portion—as most standard lighting devices are configured. The reverse-mounted lighting assembly with sealed enclosure comprises a die-cast housing E110 with perimeter support structure E111. In a preferred embodiment, said housing is composed of a die-cast aluminum. Said perimeter support structure extends perpendicularly outward from the sides of the housing E110, and supports closure and interior structures integral for sealing the enclosure. A cam-action latch system can aid in sealing the lighting assembly. Once sealed, the fixture has a water-resistant IP rating of at least 65, allowing protection from entry of dust, bugs, rain, and low-pressure power washing. Interior lighting elements are protected from mishaps due to handling or installation. Lighting elements can be relatively fragile from accidental contact caused by installation tools or even a finger nail striking an element. Enclosing the lighting elements between a high strength optical lens (see lens E235 of FIG. 25) and a heat sink (see heat sink E520 of FIG. 28) creates an impenetrable area, protecting sensitive components. Portions of the interior lighting assembly can come pre-mounted/pre-installed within the high strength optical lens forming the aforementioned top surface of the enclosure. This protects the lighting elements from accidental damage by the installer. The installer can mount the die-cast housing, connect the wires delivering power to the light fixture with typical installation tools. Once installed, the lens/lighting element/driver assembly can be latched to the housing without the use of tools.

Figure 25:
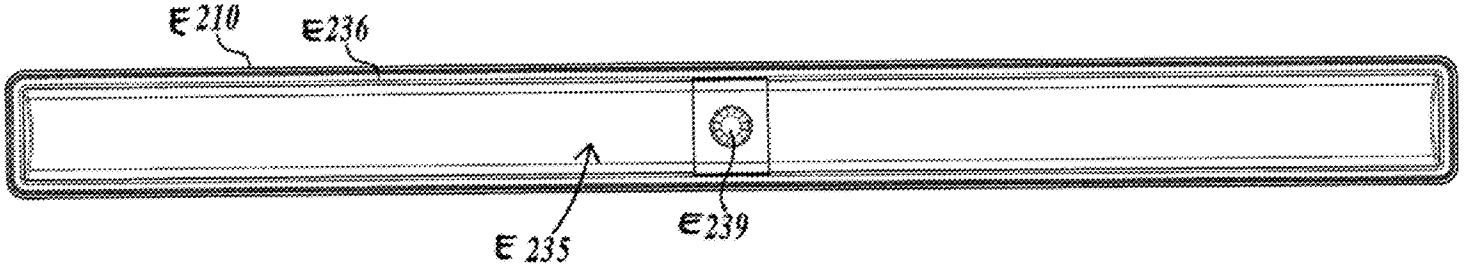
FIG. 25 illustrates an overhead top view of the reverse-mounted lighting assembly with sealed enclosure of FIG. 24.

FIG. 25 illustrates an overhead top view of the reverse-mounted lighting assembly with sealed enclosure. The high strength optical lens E235 completely covers the housing (see housing E110 of FIG. 24). It comprises a lens perimeter E236 that makes contact with the perimeter support structure (see perimeter support structure E111 of FIG. 24) of the housing E210 as part of the enclosure method. The lens E235 can possess diffusive properties, and be composed of acrylic, polycarbonate, or other appropriate polymer. It can include an optional sensor E239 found in its center region. Said sensor(s) can offer monitoring of various environmental conditions, such as ambient light levels, occupancy, temperature, etc. The interior electronics associated with such sensors would be present within the enclosure as known in the art. Additionally, a bi-directional communication circuit can be integrated into said electronics, allowing for an exchange of sensor information to occur between the lighting fixture and a separate remote host. A myriad of additional exchanges could occur via said bi-directional communication method.

Figure 26:
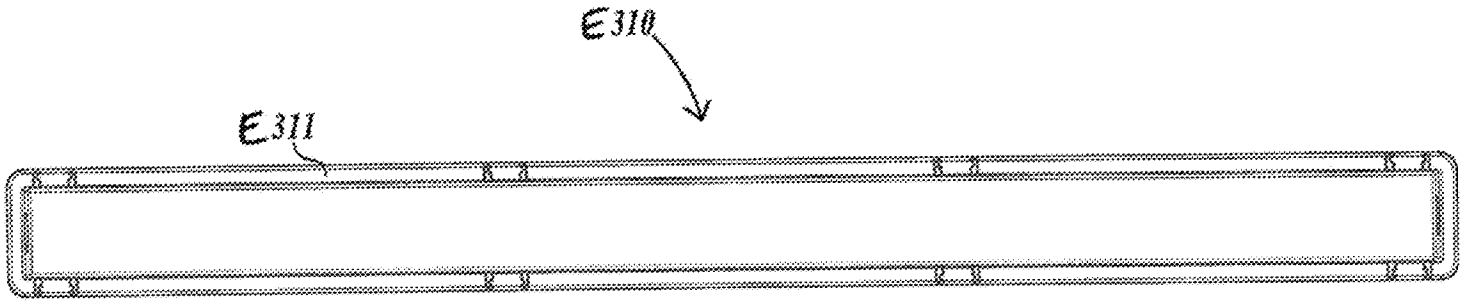
FIG. 26 illustrates an overhead bottom view of the reverse-mounted lighting assembly with sealed enclosure of FIG. 24.

FIG. 26 illustrates an overhead bottom view of the reverse-mounted lighting assembly with sealed enclosure. It comprises a die-cast housing E310 with perimeter support structure E311. An interior surface of said structure E311, lying parallel to the fixture's bottom surface, provides a contact surface for a sealing gasket (see neoprene gasket E530 of FIG. 28). Said interior surface terminates (on one edge) in a vertical extension that makes contact with the lens perimeter (see lens perimeter E536 of FIG. 28) for sealing purposes. Augmenting said sealing methods is a cam-action latch system.

Figure 27:
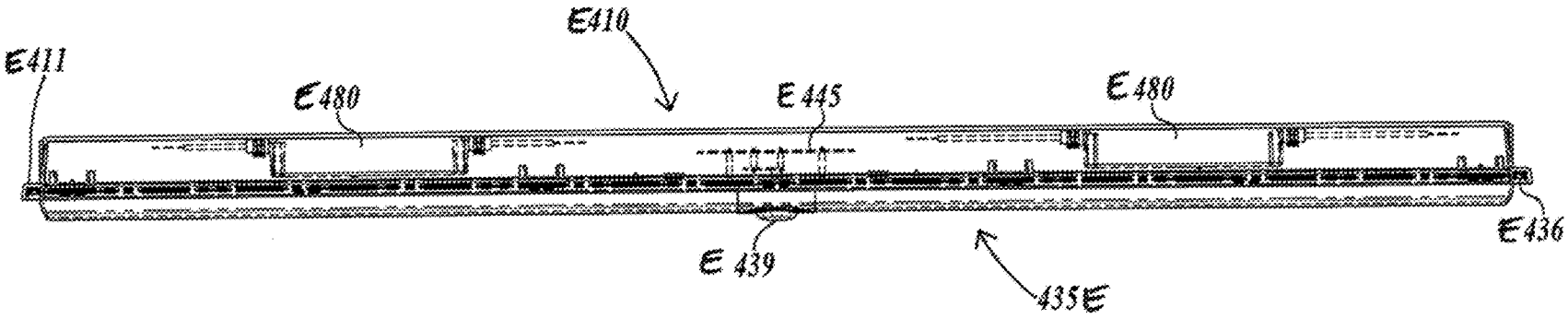
FIG. 27 illustrates a side view of the reverse-mounted lighting assembly with sealed enclosure of FIG. 24.

FIG. 27 illustrates a side view of the reverse-mounted lighting assembly with sealed enclosure. A high strength optical lens 435E makes contact with the perimeter support structure E411 of the die-cast housing E410 for a substantially sealed fixture. In a preferred embodiment, the housing E410 further comprises two power supplies E480 which flank a driver card assembly E445 in the center of the housing.

Figure 28:
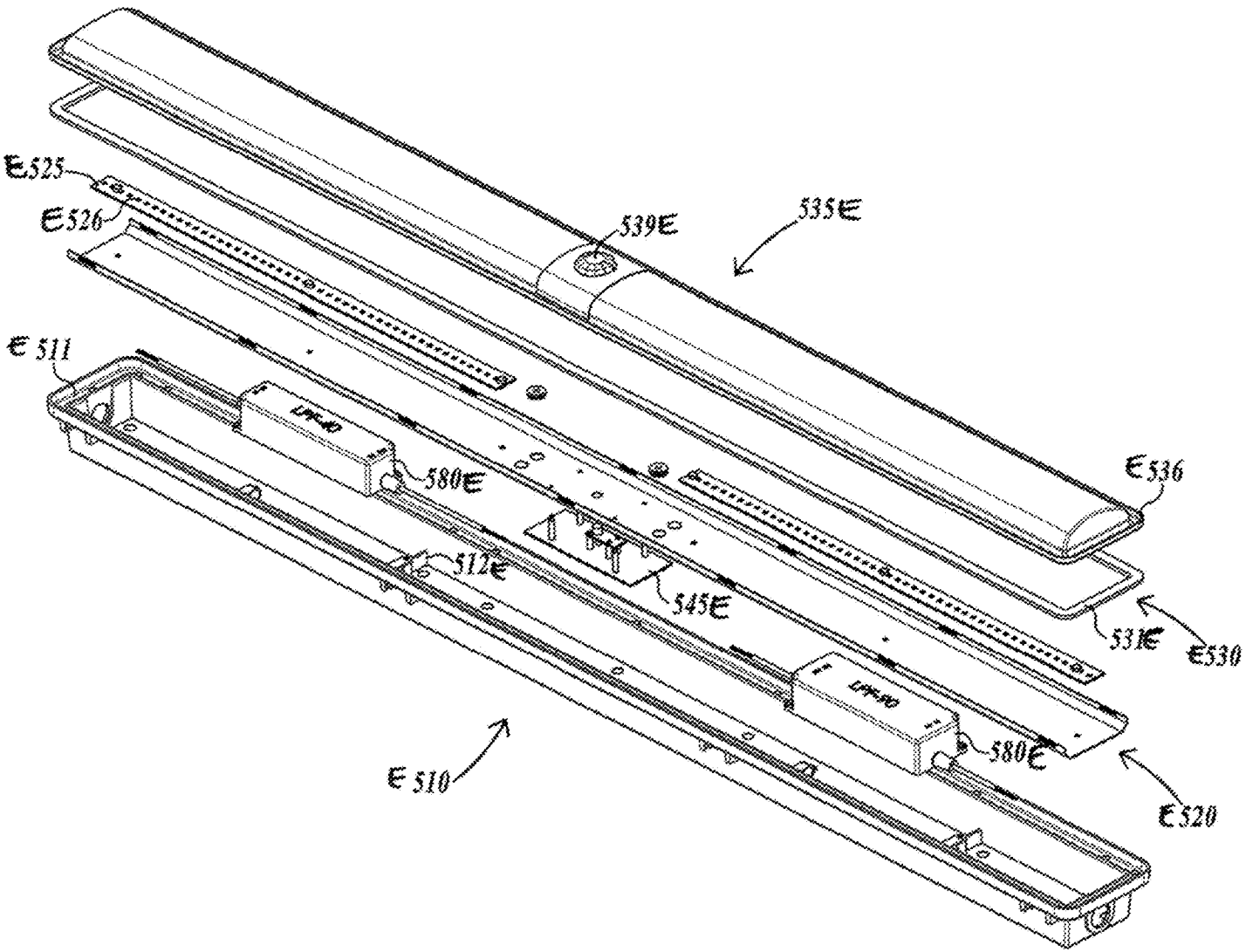
FIG. 28 illustrates a perspective exploded view of the reverse-mounted lighting assembly with sealed enclosure of FIG. 24.

FIG. 28 illustrates a perspective exploded view of the reverse-mounted lighting assembly with sealed enclosure. From bottom to top, the present invention includes a die-cast housing E510 with perimeter support structure E511, power supplies 580E, a driver card assembly 545E, a sheet metal heat sink E520, one or more printed circuit boards (PCBs) E525 with LEDs E526, a continuous-poured neoprene gasket E530 with gasket perimeter 531E, and lens 535E with lens perimeter E536 and optional sensor 539E. The plurality of LEDs E526 are mounted on one or more PCBs E525, which are mounted on the heat sink E520. Said heat sink is mounted into the high strength optical lens 535E with the gasket E530, thus creating a dedicated safe space for the sensitive lighting elements. Electronics utilized by the lighting elements are mounted to the heat sink E520. A power supply PCB can be integrated into the enclosure where appropriate, along with direct current (DC) driver electronics. Protruding from the interior side walls of the housing E510, cable clamps and associated housing ribs 512E are used on each end of a power supply to secure it to the housing. In a preferred embodiment, two clamps are used to support each power supply.

Thus, a lighting assembly comprising a plurality of lights coupled to a heat sink. The lighting assembly can further comprise an optical lens that is coupled to the heat sink. It is contemplated that a body of the lighting assembly can comprise die-cast aluminum.

F. Sealed Lighting Lens Assembly

Figure 29:
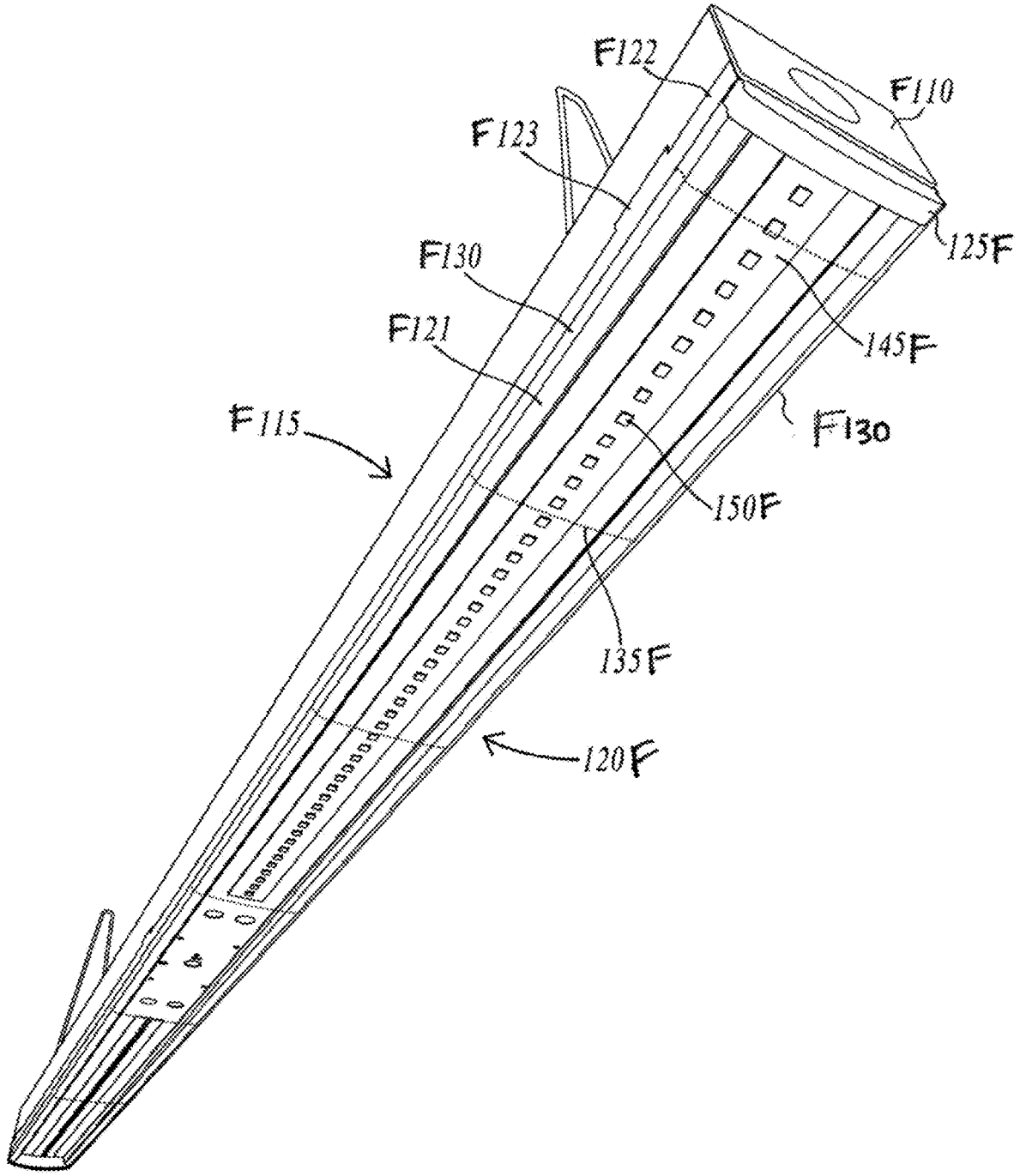
FIG. 29 illustrates a perspective top view of a fully installed, sealed lens assembly.

FIG. 29 illustrates a perspective top view of a fully installed, sealed lens assembly. The present invention is geared toward lighting fixtures that use solid-state electronic devices as the lighting elements. As such, in a preferred embodiment, the sealed lens assembly is integrated into the top cover 120F of a solid-state lighting fixture, with attached bottom housing F115 that holds other lighting components. Said bottom housing F115 is flanked by terminal faces F110. The sealed lens assembly comprises an interior tray F121 with LED strip 145F and attached LEDs 150F. A set of edge trim gaskets F130 form a bond with the side edges of the interior tray F121. An optical lens 135F (shown transparently with dotted lines) is placed over the top of said assembly, running the entire length axis of the fixture. The lens' interior side surfaces make contact with the edge trim gaskets F130. As well, the lens' terminal interior surfaces (near the bottom housing's terminal faces F110) make contact with the top surfaces of two die cut gaskets 125F.

With the lens 135F surrounding said interior lighting components and gaskets, the interior lens assembly is substantially sealed off from potential damaging external activities. This 360 degree seal can protect the interior from moisture, dust, bugs, impact etc. A resistant ingress protection ("IP") rating allows the light fixture to be used in hostile environments. Keeping bugs and dust out of the inside of the optical lens 135F means that light intensity is not diminished, aesthetics of the light are not affected, and maintenance costs are minimized by not having to open up the fixture to remove contaminants. An additional benefit of the sealed lens assembly is its ability to dissipate heat from the lighting elements. The bottom of the sealed compartment is manufactured from sheet metal, aluminum, or copper, and thus acts as a heat sink for the lighting elements. All gaskets are preferably composed of neoprene or silicone, but other materials may also be appropriate. The die cut gaskets may alternatively be composed of Volara™ closed cell foam. The optical lens 135F can have diffusive properties, and be composed of an acrylic compound, polycarbonate, or other appropriate material known in the art.

Figure 30:
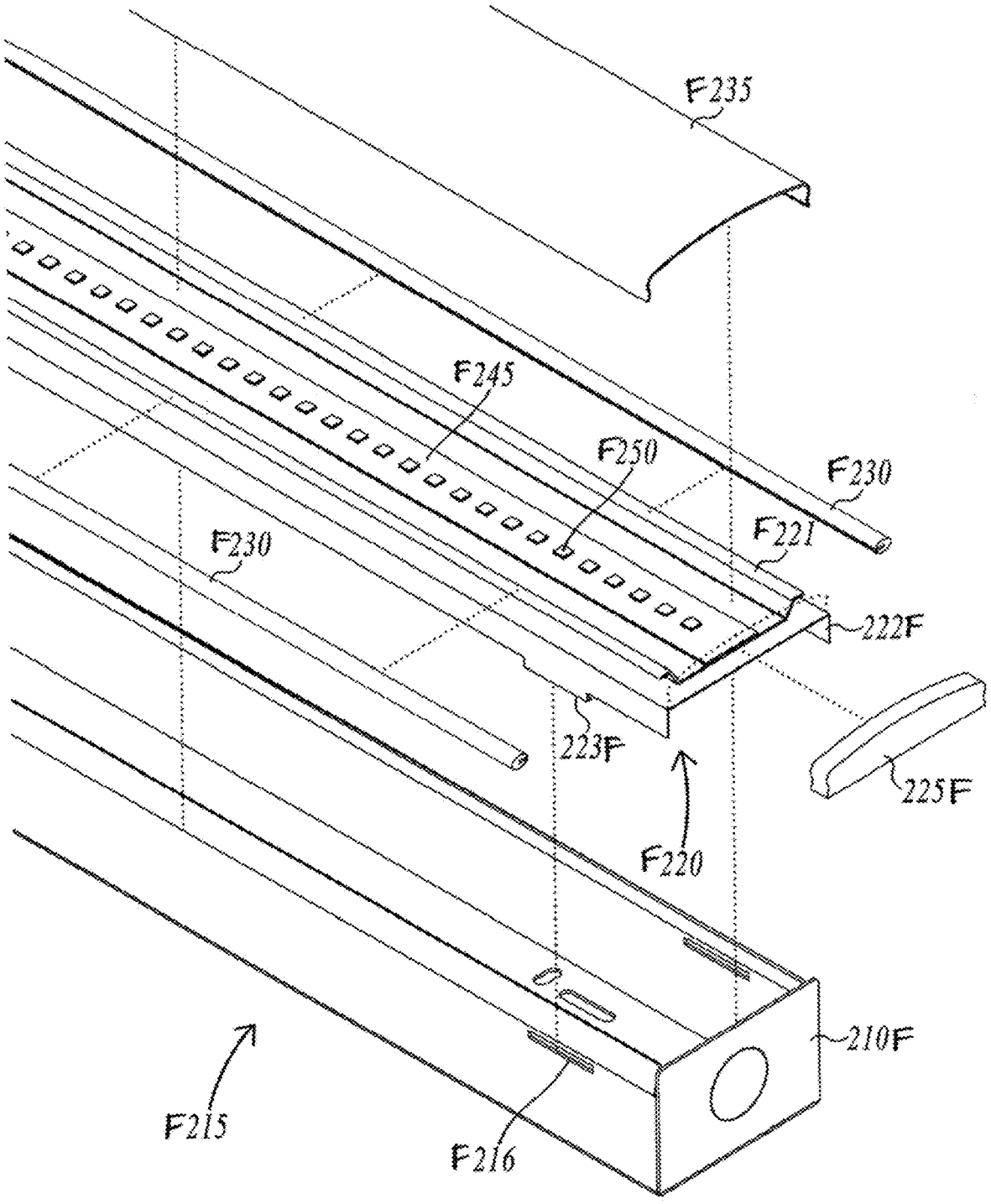
FIG. 30 illustrates an isometric exploded view of a sealed lens assembly.

FIG. 30 illustrates an isometric exploded view of a sealed lens assembly. The solid-state lighting fixture comprises a bottom housing F215 with terminal faces 210F, and a top cover F220 with integrated lens assembly. Edge trim gaskets F230 are formed around the lateral edges of interior tray F221 via narrow slots running their entire length. Said lateral edges insert into said slots for a bond that relies on compression/friction forces. The gaskets F230 can be replaced if they become dry or damaged over time. An LED strip F245 with attached LEDs F250 is affixed to the center of the interior tray F221, running along several portions of its length axis, depending on the nature of the light. An optical lens F235 placed over top of said interior lighting elements forms a seal around them, for 360 degrees of protection from external elements. The system of edge trim gaskets F230 and die cut gaskets 225F closes off the interior lens assembly at crucial junctions. Even if bugs or dust somehow entered the lens, they could not penetrate the gasket system. The result is a substantially impenetrable lens assembly.

Figure 31:
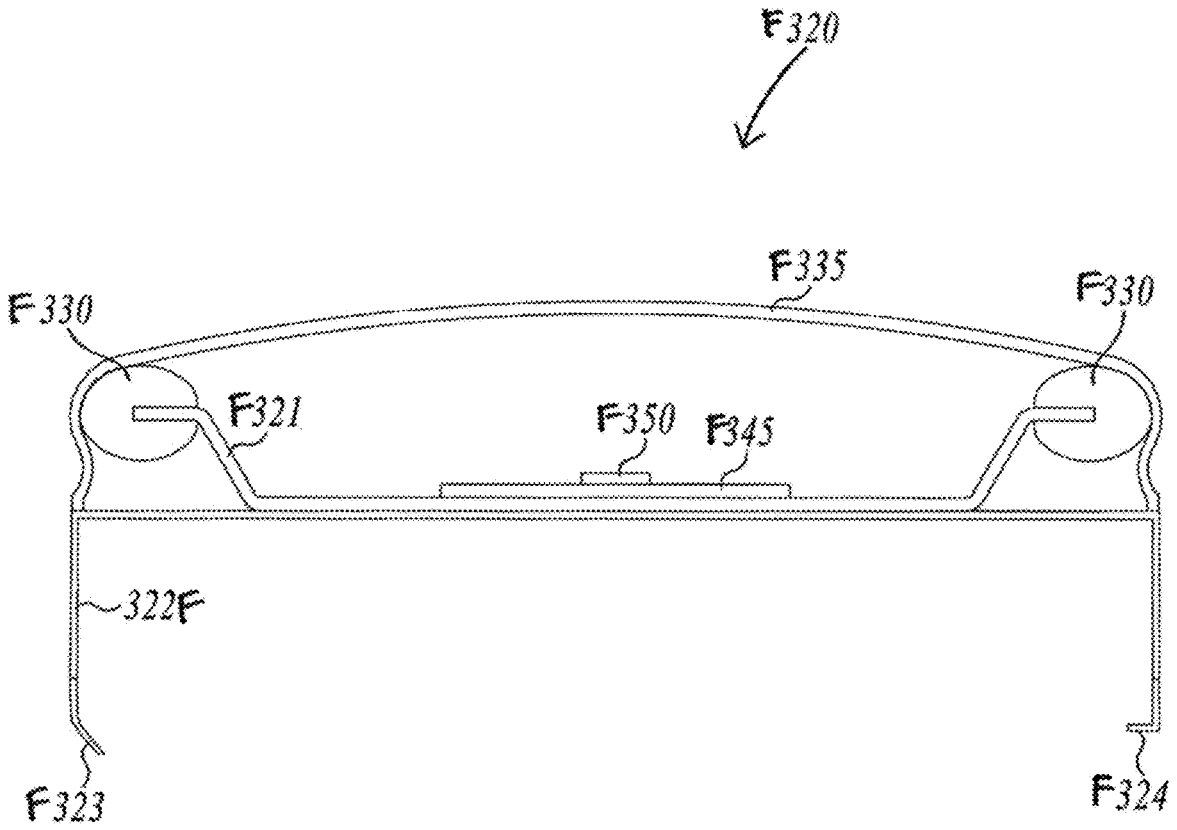
FIG. 31 illustrates a cross-sectional view through the center of a sealed lens assembly.

FIG. 31 illustrates a cross-sectional view through the center of a sealed lens assembly. Integrated into the top cover F320 of a light fixture, the lens assembly comprises an optical lens F335, two edge trim gaskets F330, and an interior tray F321 with LED strip F345 and attached LEDs F350. This figure highlights the close contact made between the edge trim gaskets F330 and the lens F335. Any unnecessary spaces between the gaskets and the lens are essentially closed off by portions of surface contact between them. This closes off the entire length of the lens assembly in a linear solid-state light. The die cut gaskets (not shown) which flank the bottom housing (not shown) and lens F335 ensure 360 degrees of closure. With these integrated safeguards, there is rarely, if ever, a need to uninstall the light for maintenance reasons. Only a minimal, infrequent cleaning regimen may be necessary, depending on the environment in which the light is placed, whereby wiping the exterior surface of the lens/fixture can remove a superficial dust layer, for example. However, because the present invention prevents the ingress of dust and insects from the entering the light fixture, the disassembly/assembly and cleaning associated with these contaminants is eliminated. The protective enclosure offered by the sealed lens assembly outperforms conventional light fixture by preventing the ingress of contaminants for the life of the light fixture, which eliminates the need for internal cleaning and prolongs fixture longevity.

Thus, a light fixture comprising an LED strip, a gasket disposed on a perimeter of the light fixture, and an optical lens that is configured to contact the gasket to seal the LED strip is contemplated.

G. Snap-Together Light Fixture Housing

Figure 32:
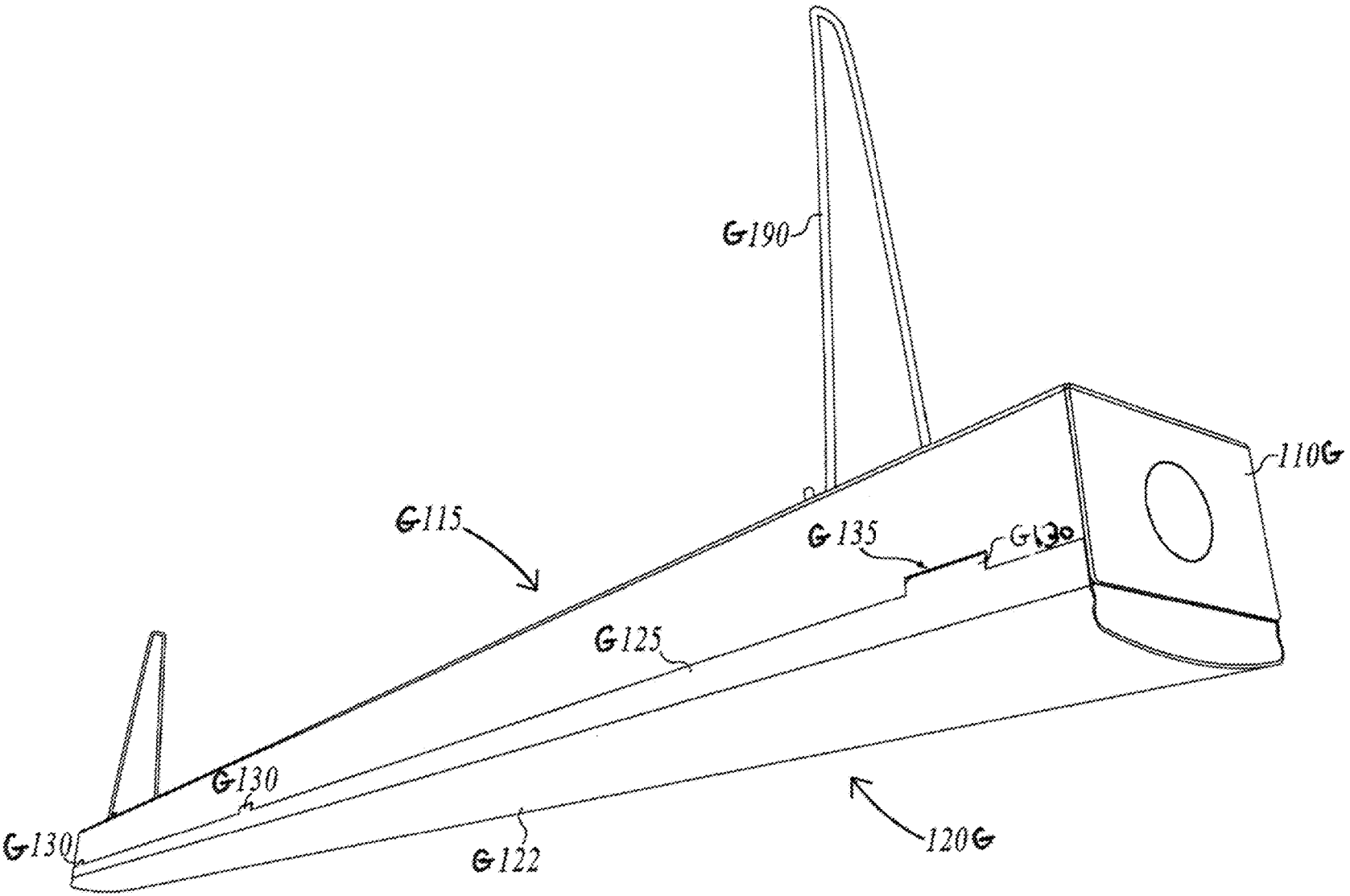
FIG. 32 illustrates a perspective side view of a fully installed snap-together light fixture housing.

FIG. 32 illustrates a perspective side view of a fully installed snap-together light fixture housing. In a preferred embodiment, the completed housing structure is characterized by an elongated, hollow rectangular body—i.e. that of a typical linear strip light. It includes provisions along/through said body that accommodate interior components. The current figure highlights the facade of one length portion. The snap-together light fixture housing comprises two enclosure pieces—a top cover 120G and a bottom housing G115. The top cover 120G further comprises an optional optical lens G122, an overhang G125, and tabs, which allow the snapping of the top cover 120G onto the bottom housing G115. Each of the two length portions of the top cover 120G have a unique set of three tabs. FIG. 32 shows the length portion with a set of three acute angle tabs G130. The bottom housing G115 further comprises terminal faces 110G on each end of the structure; these lie perpendicular to the length portions. Additionally, placed equidistantly along the entire distance of both length portions of the bottom housing G115 are six slots G135, corresponding to the aforementioned tabs found on the top cover 120G. FIG. 32 shows the three slots lying on the length portion shown, with fully inserted acute angle tabs G130. Subsequent figures will describe the mating of said tabs and slots in greater detail.

Along with a simplified method of light fixture installation, the present invention offers substantially enhanced protection for all lighting elements, from any number of damaging external elements, including impact, moisture, dust, bugs, and more. The housing can enclose electronic hardware, electrical wiring, an optional AC/DC power supply, and a protective grounding lug, all of which are safely hidden away from external elements. It can be suspended on a chain or cable with industry standard Dottie hangers G190, as shown in FIG. 32. The housing additionally provides enhanced temperature performance, with a top cover 120G that acts as a heat sink for heat generated by lighting elements, and a bottom housing G115 that acts as an additional heat sink for heat generated by the top assembly and/or optional internally mounted AC/DC power supply. A sheet metal composition for both the top cover 120G and bottom housing G115 aids in heat dissipation. Specifically, aluminum, copper, or other appropriate material may be well-suited to this end. Furthermore, the bottom housing G115 can have a finish independent from the finish of the top cover 120G, ranging from anodized, powder-coated, raw aluminum, etc. The resulting system is not only functionally superior to current lighting methods, but also delivers a highly appealing aesthetic. This is evident by the purposefully modeled components that are harmoniously and seamlessly integrated for a sleek, self-contained structure with no protruding parts, that is highly suited for display in almost any environment. Moreover, the simplistic visual qualities of the housing make it as inconspicuous as it is attractive.

Figure 33:
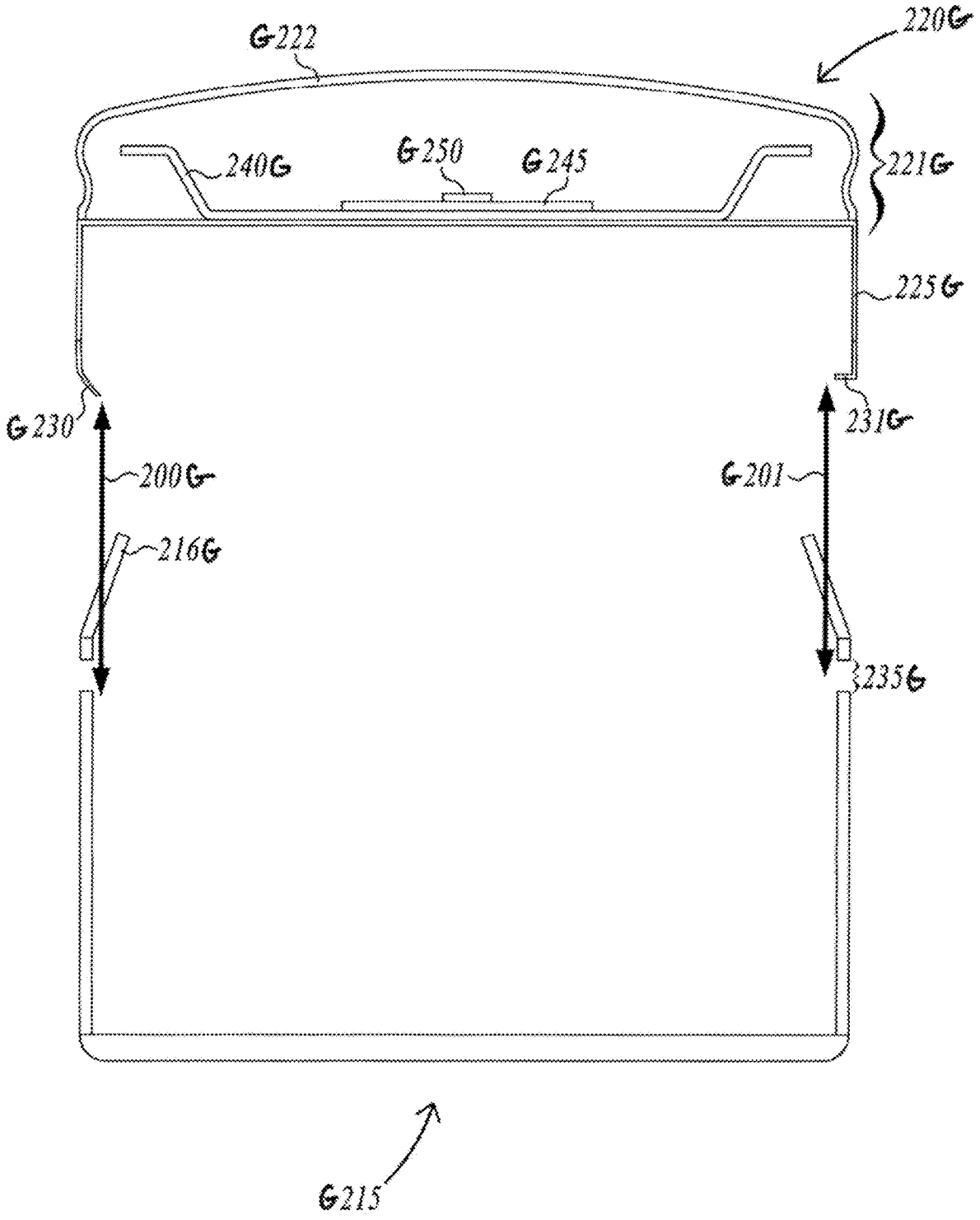
FIG. 33 illustrates a cross-sectional view through the center of the snap-together light fixture housing of FIG. 33, with top cover removed.

FIG. 33 illustrates a cross-sectional view through the center of the snap-together light fixture housing, with top cover removed. The top cover 220G includes an interior lens assembly 221G that further comprises an interior tray 240G, LED strip G245, LEDs G250, and an optical lens 222G, which covers and protects the lens assembly 221G. Additionally, the top cover 220G comprises an overhang 225G, which extends downward from the lens assembly 221G and terminates in two unique sets of three tabs on its length portions. These include acute angle tabs G230 on one length portion and right angle tabs 231G on the other length portion. The terminal edge of an acute angle tab G230 deviates from the vertical axis of the overhang at an angle less than 90 degrees. In a preferred embodiment, this angle is approximately 45 degrees. The actual angle of said tab may vary as necessary for the optimal mating of any components involved. The bottom housing G215 comprises an inward edge 216G and slots 235G which both lie on its length portions. The slots lie directly beneath the inward edge 216G. The group of six angled tabs found on the terminal bottom edge of the top cover 220G are to be inserted into said slots 235G for a full installation. This assembly method occurs without the use of any tools or fasteners. The group of three right angle tabs 231G are to be inserted first, as indicated by motion arrow G201. The group of three acute angle tabs G230 should subsequently be inserted into their respective slots 235G, as indicated by motion arrow 200G. The snapping of said tabs into place can be aided by slightly compressing the area around the slot, on the body of the bottom housing G215. Finger pressure applied to the sidewall of the bottom housing is enough to accomplish this.

Figure 34:
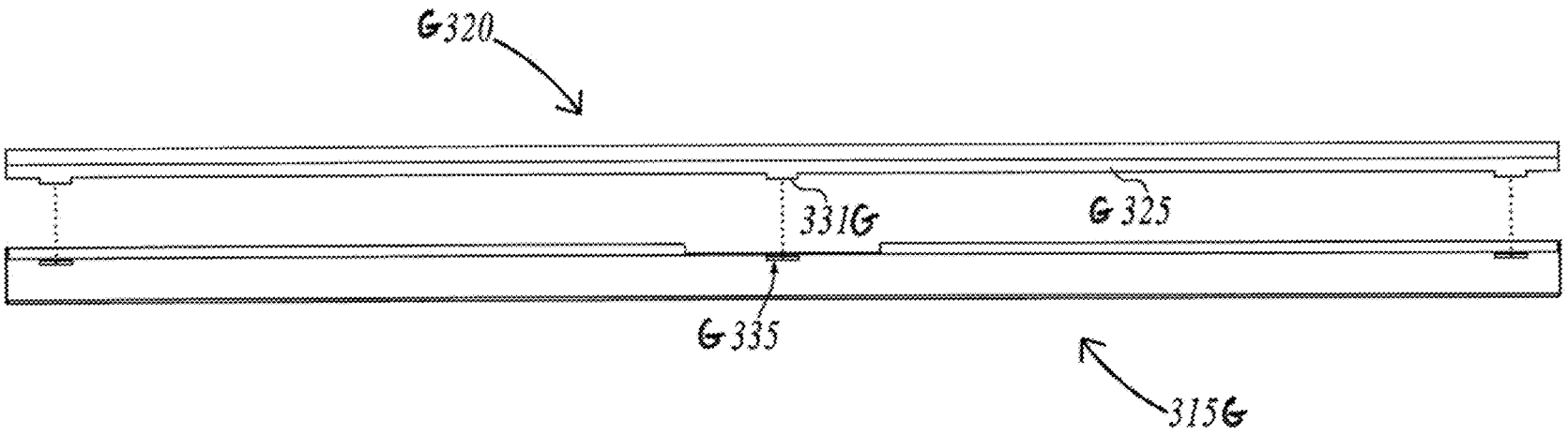
FIG. 34 illustrates a side view of the snap-together light fixture housing of FIG. 33, with top cover removed.

FIG. 34 illustrates a side view of the snap-together light fixture housing, with top cover removed. The snap-together light fixture housing comprises a top cover G320 and bottom housing 315G. The top cover G320, with overhang G325 and a set of three right angle tabs 331G running along one length portion, has been removed from the bottom housing G335 in this figure to better visualize its method of mating with the corresponding set of three slots G335 found on the length portion shown. Both sets of three slots G335 are identical size, shape, and location. During installation, the right angle tabs 331G should be placed into the slots G335 first, followed by the corresponding set of tabs found on the opposite length portion of the top cover G320 (see acute angle tabs G430 of FIG. 35). The assembly and disassembly of the housing takes only a few seconds, significantly less than the average light fixture. Its design supports softer materials such as aluminum and copper, offering better dissipation of heat than typical steel housings.

Figure 35:
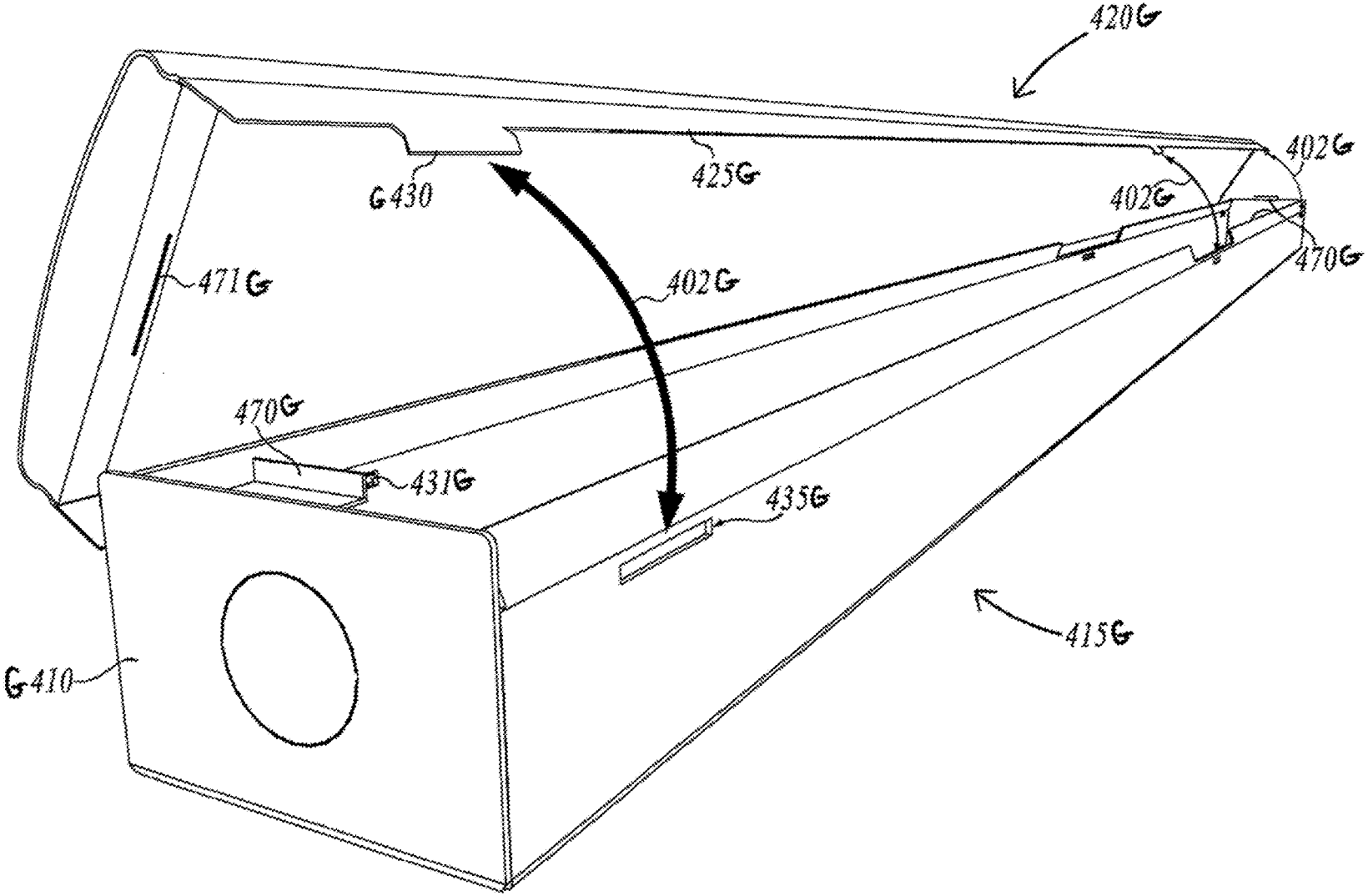
FIG. 35 illustrates a perspective side view of top cover installation/removal via acute angle tab insertion.

FIG. 35 illustrates perspective side view of top cover installation via acute angle tab insertion. The snap-together light fixture housing comprising a top cover 420G and bottom housing 415G can be locked shut by a single user without the use of tools. In this figure, the top cover 420G, with overhang 425G, acute angle tabs G430, and right angle tabs 431G, is shown partially installed in order to highlight the method of acute angle tab/slot mating. The bottom housing 415G, with slots 435G and terminal faces G410 with offset tabs 470G, is shown with the set of three right angle tabs 431G already inserted into its corresponding set of slots 435G. Said tab insertion should result in fully mated tabs/slots, whereby each right angle tab 431G lies entirely on the interior of the bottom housing 415G, and the adjacent edges of the overhang 425G make contact with the exterior surface of the bottom housing 415G. With all three right angle tabs 431G inserted, full installation of the top cover 420G is completed by rotating it downward, at the points of the right angle tabs 431G, until the terminal bottom edge of one or more acute angle tabs G430 reaches its corresponding slot 435G, and thus, the interior of the bottom housing 415G. Motion arrow 402G indicates this rotational movement. A simple push directing an acute angle tab G430 into its corresponding slot 435G is enough to snap it into place. In a preferred method of closure, the three acute angle tabs G430 are inserted in succession, starting at either end of the housing and moving toward the opposite end. To remove the top cover 420G, the same process can be executed in reverse, along with adequate finger pressure placed upon the sidewall of the bottom housing 415G to slightly compress it. This allows the terminal bottom edge of the acute angle tab G430 to more easily exit the slot 435G. Motion arrow 402G again indicates this rotational movement, in an upward direction. In addition to the set of six tabs and slots found along the length portions of the top cover 420G and bottom housing 415G respectively, there is a pair of supplementary offset tabs 470G found protruding from a top edge of each terminal face G410. Each offset tab 470G extends inward into the interior of the bottom housing 415G then upward toward the top cover 420G. In a preferred embodiment, the amount of inward extension is approximately double that of the upward extension. Said offset tabs 470G can enter into terminal slots 471G found on a bottom surface of each die cut gasket that flanks the top cover 420G. This tab/slot mating creates a secure lock between the terminal faces G410 and the top cover 420G, thus ensuring a reliable, secure locking system for the entire perimeter of the light fixture.

Figure 36:
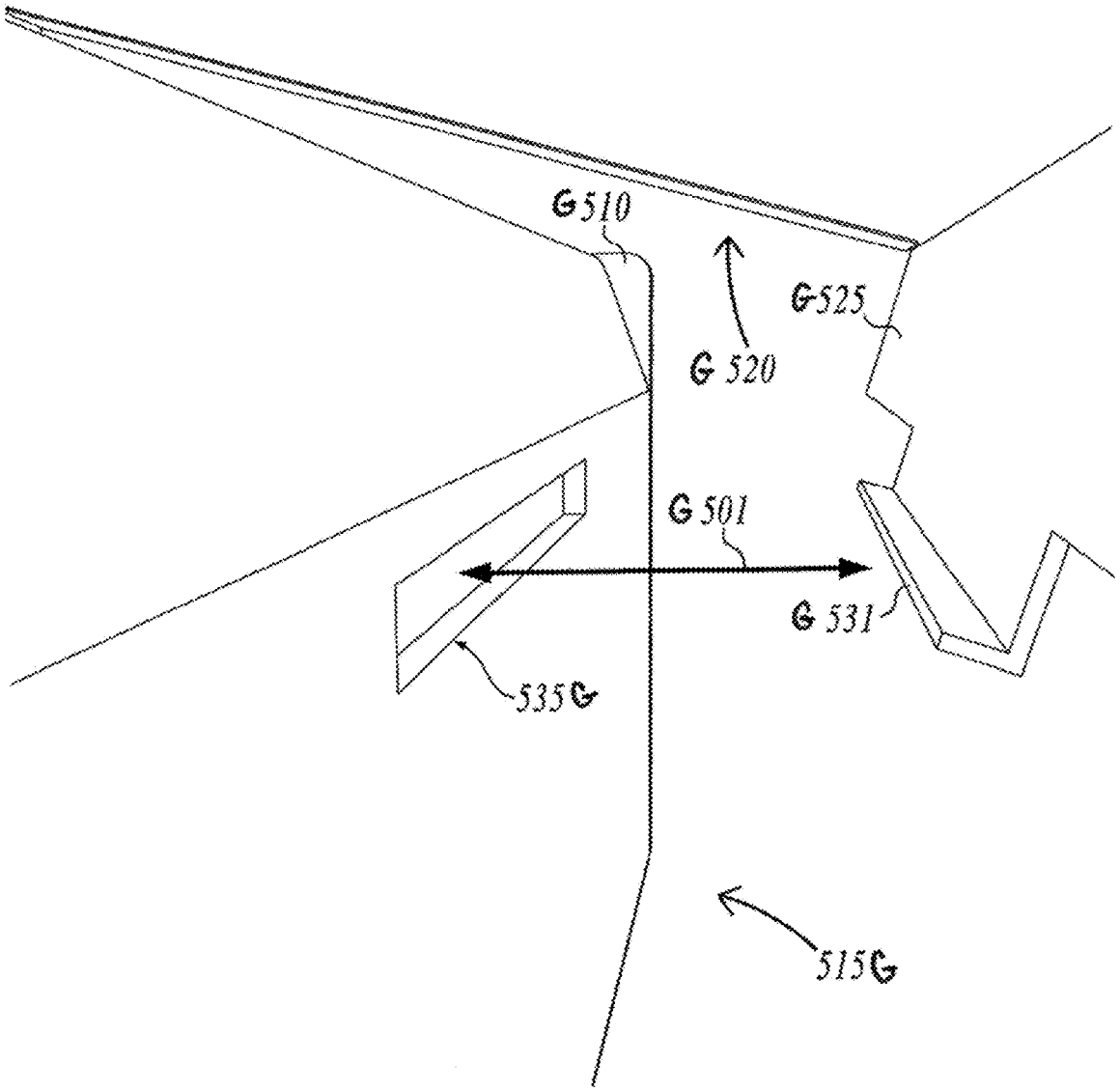
FIG. 36 illustrates a close-up perspective view of right angle tab insertion/removal.

FIG. 36 illustrates a close-up perspective view of right angle tab insertion/removal. The top cover G520 is shown a small distance above the bottom housing 515G, and comprises overhang G525 and right angle tab G531. The bottom housing comprises terminal face G510 and slot 535G. Motion arrow G501 indicates the simple horizontal movement needed to either insert or remove a right angle tab G531. Upon insertion, the protruding edge of the right angle tab G531 will be placed into the interior of the bottom housing 515G via the slot 535G, while the portion perpendicular to this edge makes contact with an exterior surface of the bottom housing. During top cover installation, insertion of the right angle tabs G531 should precede insertion of the corresponding acute angle tabs (see acute angle tab G630 of FIG. 37).

Figure 37:
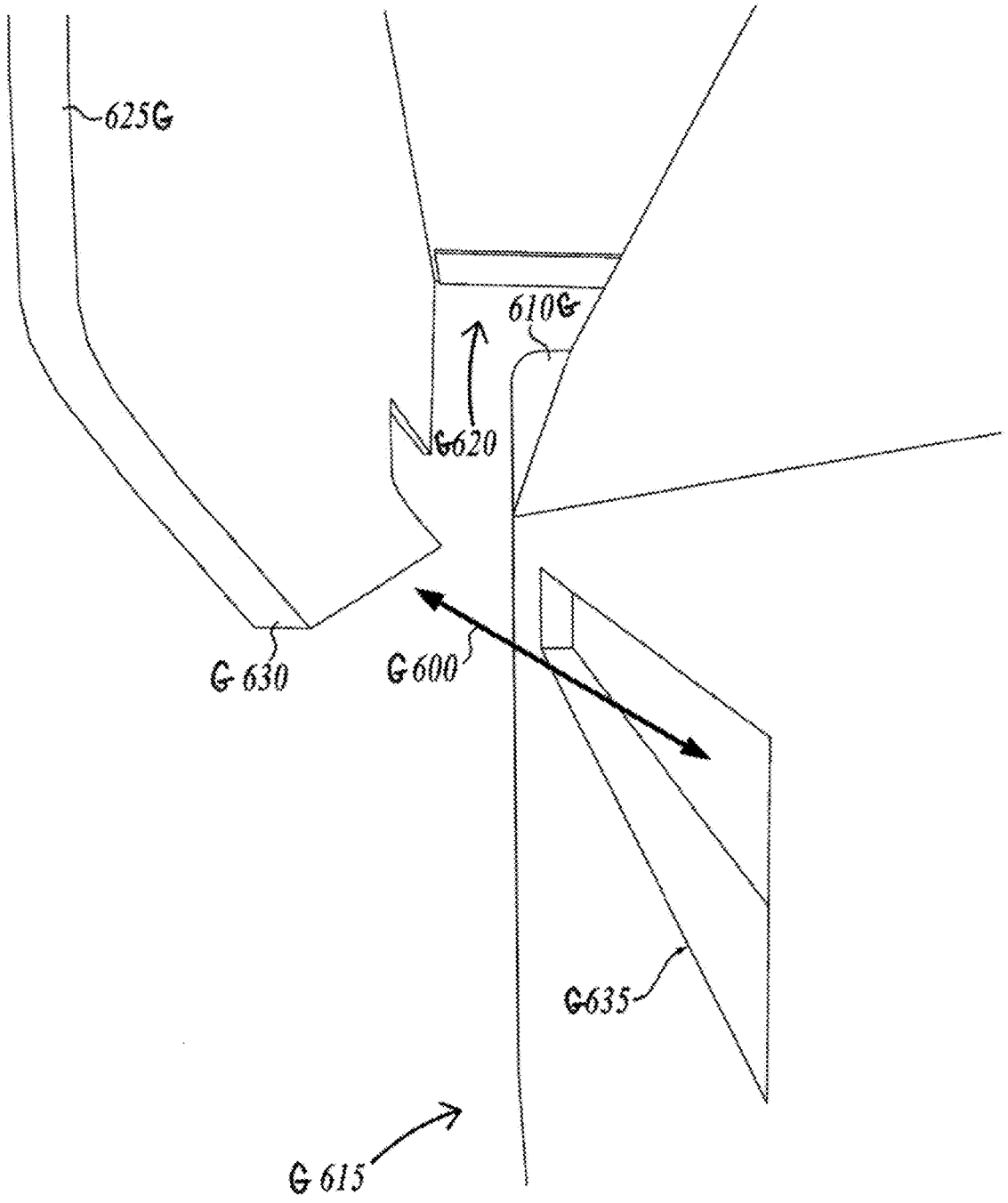
FIG. 37 illustrates a close-up perspective view of acute angle tab insertion/removal.

FIG. 37 illustrates a close-up perspective view of acute angle tab insertion/removal. The top cover G620 is shown a small distance above the bottom housing G615, and comprises overhang 625G and acute angle tab G630. The bottom housing comprises terminal face 610G and slot G635. Motion arrow G600 indicates the simple angled movement needed to either insert or remove an acute angle tab G630. Upon insertion, a portion of the acute angle tab G630 will be placed into the interior of the bottom housing G615 via the slot G635, locking it into place by placing its terminal edge below the opening of the slot. Said tab can only be removed by the methods described in previous figures, i.e. not under the normal conditions of regular usage. As previously mentioned, a directed compression of the bottom housing's side wall is required to initiate tab removal—which furthermore requires an upward rotational movement in addition to said compression. During top cover installation, insertion of the acute angle tabs G630 should follow insertion of the corresponding right angle tabs (see right angle tab G531 of FIG. 36).

Figure 38:
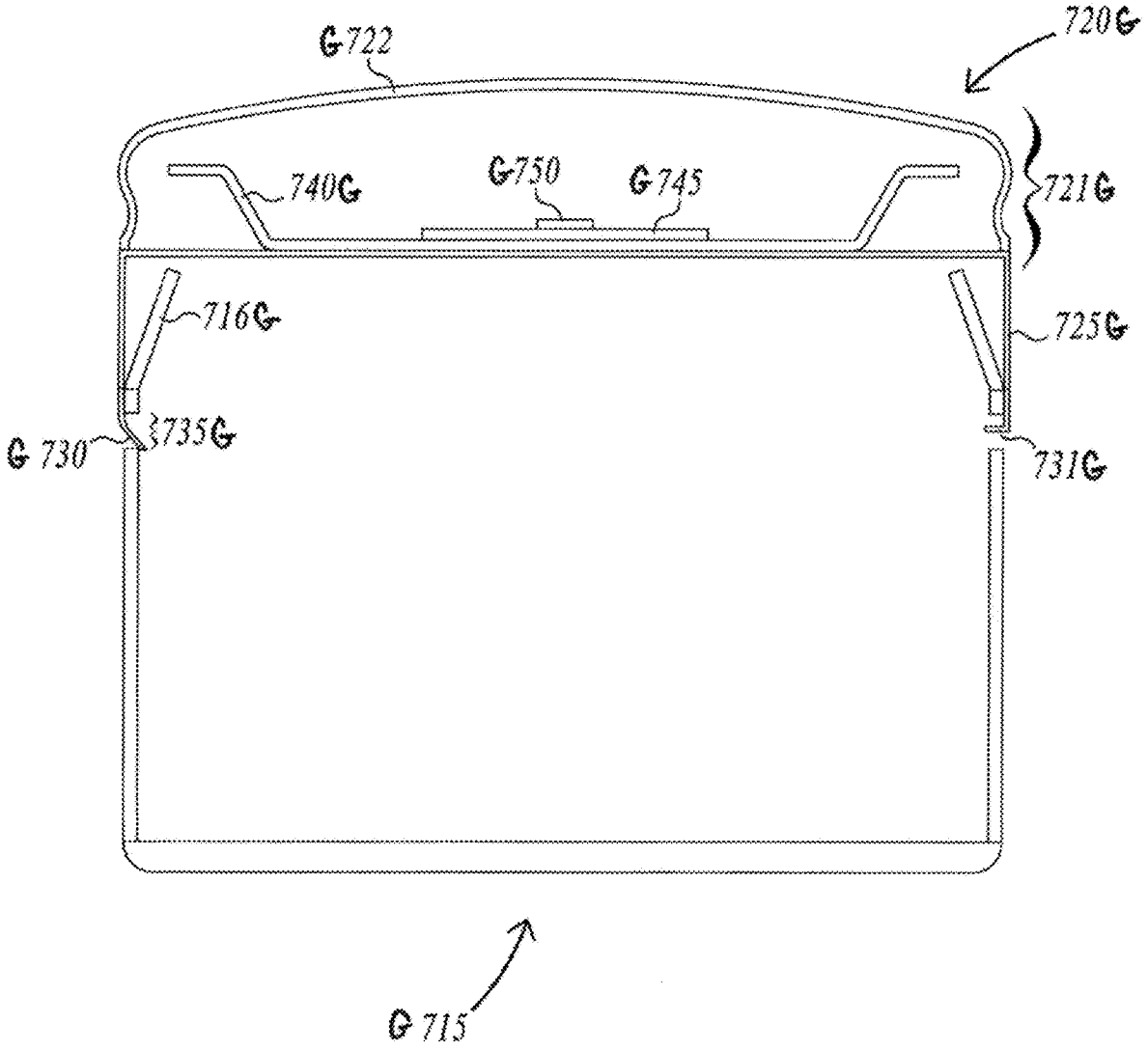
FIG. 38 illustrates a cross-sectional view through the center of a fully installed snap-together light fixture housing.

FIG. 38 illustrates a cross-sectional view through the center of a fully installed snap-together light fixture housing. The top cover 720G includes an interior lens assembly 721G that further comprises an interior tray 740G, LED strip G745, LEDs G750, and an optical lens G722. The top cover 720G also comprises an overhang 725G, which extends downward from the lens assembly 721G and terminates in two unique sets of three tabs on its length portions. These are the acute angle tabs G730 found on one length portion, and the right angle tabs 731G found on the other length portion. The bottom housing G715 comprises an inward edge 716G and slots 735G which both lie on its length portions. The slots lie directly beneath the inward edge 716G. In this figure, the group of six angled tabs found on the terminal bottom edge of the top cover 720G have been fully inserted into said slots 735G for a full installation of the housing. This assembly method occurs without the use of any tools or fasteners. The snap-together light fixture housing is designed to mount and support the lighting element, provide a means to mount the fixture to a ceiling or suspend the fixture from the ceiling on cables, and enclose power supplies, electrical wires and disconnect connectors, protecting people from contacting live wires and dressing the appearance of the housing. Additional customizable features include an integrated ambient light sensor and/or occupancy sensor for automated lighting functions, minimizing unnecessary periods of operation and cutting costs for the user. Said components are readily integrated into the top cover 720G.

Thus, a light fixture comprising a top cover and a bottom housing is contemplated. The top cover can comprise tabs and the bottom housing can comprise slots sized and dimensioned to receive the tabs to couple the top cover with the bottom housing.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A lighting system comprising:

an elongated light housing comprising at least first and second lighting elements;

a lens;

gasket material configured to mate with the light housing and the lens to form a dust proof sealed area between the light housing and the lens; and electronics that provides from the same power source, a first level of constant current to the first lighting element and a second, different level of constant current to the second lighting element.

2. The lighting system of claim 1, further comprising an occupancy sensor disposed in the dust proof sealed area.

3. The lighting system of claim 1, further comprising an external power supply, and wherein the light fixture is configured to receive power only from the external power supply.

4. The lighting system of claim 1, wherein the gasket material includes (a) left and right elongated gaskets disposed within left and right slots of the light housing, and (b) end gaskets that mate with the left and right elongated gaskets.

5. The lighting system of claim 4, wherein the gasket material comprises at least one of neoprene, silicone, and a closed cell foam.

6. The lighting system of claim 4, wherein the set of multiple lighting elements comprises an array of light emitting diodes.

7. The lighting system of claim 4, further comprising a metal housing mechanically coupled to the light housing, and configured to operate as a heat sink to draw heat away from the lighting elements.

8. The lighting system of claim 7, further comprising tabs and tab slots that cooperate to couple the light housing with the metal housing.

9. The lighting system of claim 1, wherein the electronics comprises a diver card having a first pluggable module that provides the first level of constant current, and a second, different pluggable module that provides the second level of constant current.

* * * * *